US008201908B2

(12) United States Patent
Tanoue et al.

(10) Patent No.: US 8,201,908 B2
(45) Date of Patent: Jun. 19, 2012

(54) FLUID EJECTING APPARATUS AND FLUID EJECTING METHOD

(75) Inventors: Takeshi Tanoue, Nagano-ken (JP); Bunji Ishimoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 148 days.

(21) Appl. No.: 12/849,995

(22) Filed: Aug. 4, 2010

(65) Prior Publication Data

US 2011/0043560 A1 Feb. 24, 2011

(30) Foreign Application Priority Data

Aug. 18, 2009 (JP) ..... 2009-188944

(51) Int. Cl.
*B41J 29/38* (2006.01)

(52) U.S. Cl. ..... 347/12

(58) Field of Classification Search ..... 347/9, 12, 347/40–42, 101, 102, 104
See application file for complete search history.

(56) References Cited

U.S. PATENT DOCUMENTS 6,511,144 B2 * 1/2003 Otsuki ..... 347/12
7,267,425 B2 * 9/2007 Kawase et al. ..... 347/43

FOREIGN PATENT DOCUMENTS

JP 2002-038063 2/2002

* cited by examiner

*Primary Examiner* — An Do

(57) ABSTRACT

A fluid ejecting apparatus includes: a first nozzle line that includes a plurality of first nozzles that are aligned in a predetermined direction, first fluid being ejected from the first nozzles; a second nozzle line that includes a plurality of second nozzles that are aligned in the predetermined direction, second fluid being ejected from the second nozzles; a movement mechanism that moves the first nozzle line and the second nozzle line relative to a target medium in a movement direction, the movement direction being orthogonal to the predetermined direction; a transportation mechanism that transports the target medium relative to the first nozzle line and the second nozzle line in the predetermined direction; a controlling section that performs control for repeating image formation operation and transportation operation; and a group of nozzles that are not the first nozzles nor the second nozzles.

6 Claims, 15 Drawing Sheets

FLUID EJECTING APPARATUS AND FLUID EJECTING METHOD

CROSS-REFERENCE TO RELATED APPLICATION(S)

Japanese Patent application No. 2009-188944 is hereby incorporated by reference in its entirety.

BACKGROUND

1. Field of Invention

The present invention relates to a fluid ejecting apparatus and a fluid ejecting method.

2. Description of Related Art

An ink-jet printer having a plurality of nozzles from which ink (fluid) is ejected onto a print target medium is known as an example of a fluid ejecting apparatus. The nozzles are aligned in a predetermined direction to constitute a nozzle line(s). Some known ink-jet printers performs operation for ejecting ink from nozzles while moving nozzle lines in a movement direction, which is the direction that is orthogonal to the predetermined direction, and operation for transporting a print target medium in the predetermined direction repeatedly.

A printing apparatus that performs printing by using white ink in addition to color ink such as cyan, magenta, and yellow ink is known in the art. An example of such a printer is disclosed in JP-A-2002-038063. The printer such as the disclosed one uses white ink for base coat treatment. The white base coating makes it possible to form a color print image having excellent color development property without being influenced by the ground color of a print target medium.

An example of base coat treatment with the use of white ink is the printing of a background image on a print target medium by using white ink first and the printing of a color image on the background image by using color ink thereafter. Generally, the colors of ink called roughly as white ink actually differ from one to another in the strict sense. In view of such color differences, in some cases, printing is performed with the use of white ink and color ink to form a desired white background image. When the base coat treatment is performed, a color image is printed after the lapse of drying time, which is the time for drying a background image after the printing of the background image. By this means, it is possible to prevent ink from running thereon. However, if the length of the background drying time is not constant, the depth of shade of an image obtained will not be uniform.

SUMMARY OF INVENTION

An advantage of some aspects of the invention is to provide a technique for suppressing variation in the length of drying time.

In order to offer the above advantage, though not limited thereto, a main aspect of the invention provides a fluid ejecting apparatus that includes: a first nozzle line that includes a plurality of first nozzles that are aligned in a predetermined direction, first fluid being ejected from the first nozzles; a second nozzle line that includes a plurality of second nozzles that are aligned in the predetermined direction, second fluid being ejected from the second nozzles; a movement mechanism that moves the first nozzle line and the second nozzle line relative to a target medium in a movement direction, the movement direction being orthogonal to the predetermined direction; a transportation mechanism that transports the target medium relative to the first nozzle line and the second nozzle line in the predetermined direction; a controlling section that performs control for repeating image formation operation and transportation operation, the image formation operation being operation for ejecting the first fluid from the first nozzles and ejecting the second fluid from the second nozzles while moving the first nozzle line and the second nozzle line in the movement direction by means of the movement mechanism, the transportation operation being operation for transporting the target medium relative to the first nozzle line and the second nozzle line in the predetermined direction by predetermined transportation amount by means of the transportation mechanism; and a group of nozzles that are not the first nozzles nor the second nozzles, wherein the image formation operation includes a certain image formation operation and another image formation operation, the controlling section performs control for forming a first image by using the first fluid and the second fluid in the certain image formation operation, the controlling section performs control for forming a second image on the first image by using at least the second fluid in the another image formation operation after lapse of time for drying the first image, the first nozzles and the second nozzles that are used for forming the first image are located upstream of the second nozzles that are used for forming the second image in the predetermined direction, the group of nozzles that are not the first nozzles nor the second nozzles are located downstream of the first nozzles and the second nozzles that are used for forming the first image in the predetermined direction, the group of nozzles that are not the first nozzles nor the second nozzles are located upstream of the second nozzles that are used for forming the second image in the predetermined direction, length of an area where the group of nozzles that are not the first nozzles nor the second nozzles are located in the predetermined direction is an integral multiple of the predetermined transportation amount, and the group of nozzles that are not the first nozzles nor the second nozzles do not eject any fluid.

Other features and advantages offered by the invention will be fully understood by referring to the following detailed description in conjunction with the accompanying drawings.

BRIEF DESCRIPTION OF THE DRAWINGS

The invention will be described with reference to the accompanying drawings, wherein like numbers reference like elements.

DESCRIPTION OF THE PREFERRED EMBODIMENTS

Figure 1:
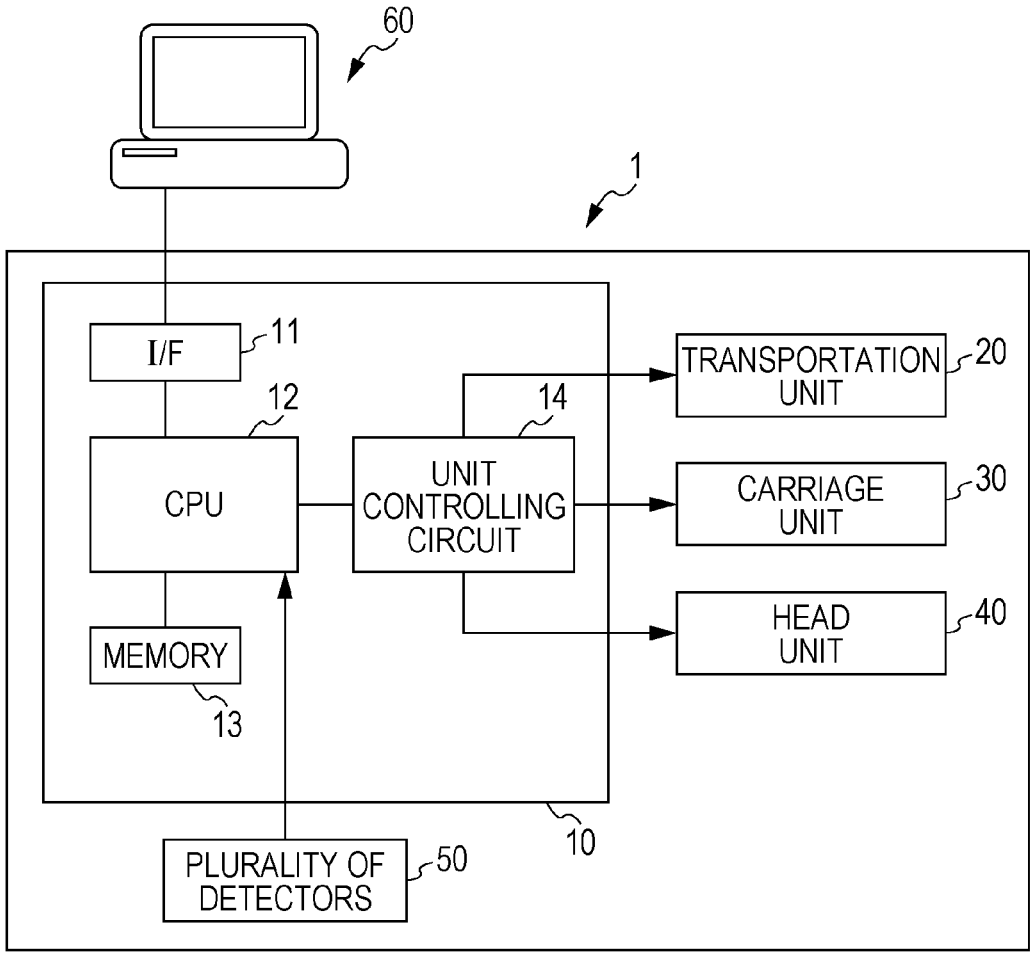
FIG. 1 is a block diagram that schematically illustrates an example of the overall configuration of a printer according to an exemplary embodiment of the invention.

Overview of Fluid Ejecting Apparatus and Fluid Ejecting Method

Referring to the following detailed description in conjunction with the accompanying drawings, one will fully understand at least the following inventive concept of the invention.

A fluid ejecting apparatus having the following features is disclosed in the detailed description of the invention and the accompanying drawings. The fluid ejecting apparatus includes: a first nozzle line that includes a plurality of first nozzles that are aligned in a predetermined direction, first fluid being ejected from the first nozzles; a second nozzle line that includes a plurality of second nozzles that are aligned in the predetermined direction, second fluid being ejected from the second nozzles; a movement mechanism that moves the first nozzle line and the second nozzle line relative to a target medium in a movement direction, the movement direction being orthogonal to the predetermined direction; a transportation mechanism that transports the target medium relative to the first nozzle line and the second nozzle line in the predetermined direction; a controlling section that performs control for repeating image formation operation and transportation operation, the image formation operation being operation for ejecting the first fluid from the first nozzles and ejecting the second fluid from the second nozzles while moving the first nozzle line and the second nozzle line in the movement direction by means of the movement mechanism, the transportation operation being operation for transporting the target medium relative to the first nozzle line and the second nozzle line in the predetermined direction by predetermined transportation amount by means of the transportation mechanism; and a group of nozzles that are not the first nozzles nor the second nozzles, wherein the image formation operation includes a certain image formation operation and another image formation operation, the controlling section performs control for forming a first image by using the first fluid and the second fluid in the certain image formation operation, the controlling section performs control for forming a second image on the first image by using at least the second fluid in the another image formation operation after lapse of time for drying the first image, the first nozzles and the second nozzles that are used for forming the first image are located upstream of the second nozzles that are used for forming the second image in the predetermined direction, the group of nozzles that are not the first nozzles nor the second nozzles are located downstream of the first nozzles and the second nozzles that are used for forming the first image in the predetermined direction, the group of nozzles that are not the first nozzles nor the second nozzles are located upstream of the second nozzles that are used for forming the second image in the predetermined direction, length of an area where the group of nozzles that are not the first nozzles nor the second nozzles are located in the predetermined direction is an integral multiple of the predetermined transportation amount, and the group of nozzles that are not the first nozzles nor the second nozzles do not eject any fluid. A fluid ejecting apparatus according to the above aspect of the invention is capable of making the length of time for drying the first image constant. For example, if the fluid ejecting apparatus is a printing apparatus, it is possible to suppress non-uniformity in the depth of shade of an image obtained.

In the configuration of a fluid ejecting apparatus according to the above aspect of the invention, it is preferable that the length of the area in the predetermined direction should vary depending on drying characteristics of the first image formed on the target medium. A fluid ejecting apparatus having such a preferred configuration makes it possible to avoid deterioration in image quality due to the running of fluid reliably and shorten time required for image formation operation as much as possible.

In the configuration of a fluid ejecting apparatus according to the above aspect of the invention, it is preferable that each of length of an area where the first nozzles and the second nozzles that are used for forming the first image are located in the predetermined direction and length of an area where the second nozzles that are used for forming the second image are located in the predetermined direction should be an integral multiple of the predetermined transportation amount. A fluid ejecting apparatus having such a preferred configuration is capable of making the number of times of execution of image formation operation constant for each of the images.

In the configuration of a fluid ejecting apparatus according to the above aspect of the invention, it is preferable that the second image should be formed by using the first fluid and the second fluid, the first nozzles and the second nozzles that are used for forming the first image should be located upstream of the first nozzles and the second nozzles that are used for forming the second image in the predetermined direction, the group of nozzles that are not the first nozzles nor the second nozzles should be located downstream of the first nozzles and the second nozzles that are used for forming the first image in the predetermined direction, the group of nozzles that are not the first nozzles nor the second nozzles should be located upstream of the first nozzles and the second nozzles that are used for forming the second image in the predetermined direction, the length of the area where the group of nozzles that are not the first nozzles nor the second nozzles are located in the predetermined direction should be an integral multiple of the predetermined transportation amount, and the group of nozzles that are not the first nozzles nor the second nozzles do not eject any fluid. A fluid ejecting apparatus having such a preferred configuration is capable of suppressing non-uniformity in the depth of shade of an image obtained. For example, if the fluid ejecting apparatus is a printing apparatus, it is possible to improve the color reproduction property of the second image.

A fluid ejecting apparatus according to another aspect of the invention includes: a first nozzle line that includes a plurality of first nozzles that are aligned in a predetermined direction, first fluid being ejected from the first nozzles; a second nozzle line that includes a plurality of second nozzles that are aligned in the predetermined direction, second fluid being ejected from the second nozzles; a movement mechanism that moves the first nozzle line and the second nozzle line relative to a target medium in a movement direction, the movement direction being orthogonal to the predetermined direction; a transportation mechanism that transports the target medium relative to the first nozzle line and the second nozzle line in the predetermined direction; a controlling section that performs control for repeating image formation operation and transportation operation, the image formation operation being operation for ejecting the first fluid from the first nozzles and ejecting the second fluid from the second nozzles while moving the first nozzle line and the second nozzle line in the movement direction by means of the movement mechanism, the transportation operation being operation for transporting the target medium relative to the first nozzle line and the second nozzle line in the predetermined direction by predetermined transportation amount by means of the transportation mechanism; and a group of nozzles that are not the first nozzles nor the second nozzles, wherein the image formation operation includes a certain image formation operation and another image formation operation, the controlling section performs control for forming a first image by using the first fluid in the certain image formation operation, the controlling section performs control for forming a second image on the first image by using the first fluid and the second fluid in the another image formation operation after lapse of time for drying the first image, the first nozzles that are used for forming the first image are located upstream of the first nozzles and the second nozzles that are used for forming the second image in the predetermined direction, the group of nozzles that are not the first nozzles nor the second nozzles are located downstream of the first nozzles that are used for forming the first image in the predetermined direction, the group of nozzles that are not the first nozzles nor the second nozzles are located upstream of the first nozzles and the second nozzles that are used for forming the second image in the predetermined direction, length of an area where the group of nozzles that are not the first nozzles nor the second nozzles are located in the predetermined direction is an integral multiple of the predetermined transportation amount, and the group of nozzles that are not the first nozzles nor the second nozzles do not eject any fluid. A fluid ejecting apparatus according to the above aspect of the invention is capable of making the length of time for drying the first image constant. For example, if the fluid ejecting apparatus is a printing apparatus, it is possible to suppress non-uniformity in the depth of shade of an image obtained.

A fluid ejecting method used by a fluid ejecting apparatus is also provided. The fluid ejecting apparatus has a first nozzle line and a second nozzle line. The first nozzle line includes a plurality of first nozzles that are aligned in a predetermined direction for ejecting first fluid therefrom. The second nozzle line includes a plurality of second nozzles that are aligned in the predetermined direction for ejecting second fluid therefrom. The fluid ejecting method includes: image formation operation for ejecting the first fluid from the first nozzles and ejecting the second fluid from the second nozzles while moving the first nozzle line and the second nozzle line in a movement direction that is orthogonal to the predetermined direction, the image formation operation including a certain image formation operation, and another image formation operation; and transportation operation for transporting a target medium relative to the first nozzle line and the second nozzle line in the predetermined direction by predetermined transportation amount, wherein the image formation operation and the transportation operation are performed repeatedly, in order to form a first image by using the first fluid and the second fluid in the certain image formation operation and form a second image on the first image by using the second fluid in the another image formation operation after lapse of time for drying the first image, the first fluid and the second fluid are respectively ejected from the first nozzles and the second nozzles that are used for forming the first image, and in addition, the second fluid is ejected from the second nozzles that are used for forming the second image and are located downstream of the first nozzles and the second nozzles that are used for forming the first image in the predetermined direction, a group of nozzles that are not the first nozzles nor the second nozzles are located downstream of the first nozzles and the second nozzles that are used for forming the first image in the predetermined direction, the group of nozzles that are not the first nozzles nor the second nozzles are located upstream of the second nozzles that are used for forming the second image in the predetermined direction, length of an area where the group of nozzles that are not the first nozzles nor the second nozzles are located in the predetermined direction is an integral multiple of the predetermined transportation amount, and the group of nozzles that are not the first nozzles nor the second nozzles do not eject any fluid. A fluid ejecting method according to the above aspect of the invention makes it possible to make the length of time for drying the first image constant. For example, if the fluid ejecting method is a printing method, it is possible to suppress non-uniformity in the depth of shade of an image obtained.

Printing System

In the following description of exemplary embodiments of the invention, an ink-jet printer is explained as an example of a fluid ejecting apparatus. Among various ink-jet printers, a serial printer (hereinafter referred to as "printer 1") is taken as an example.

Figure 2A:
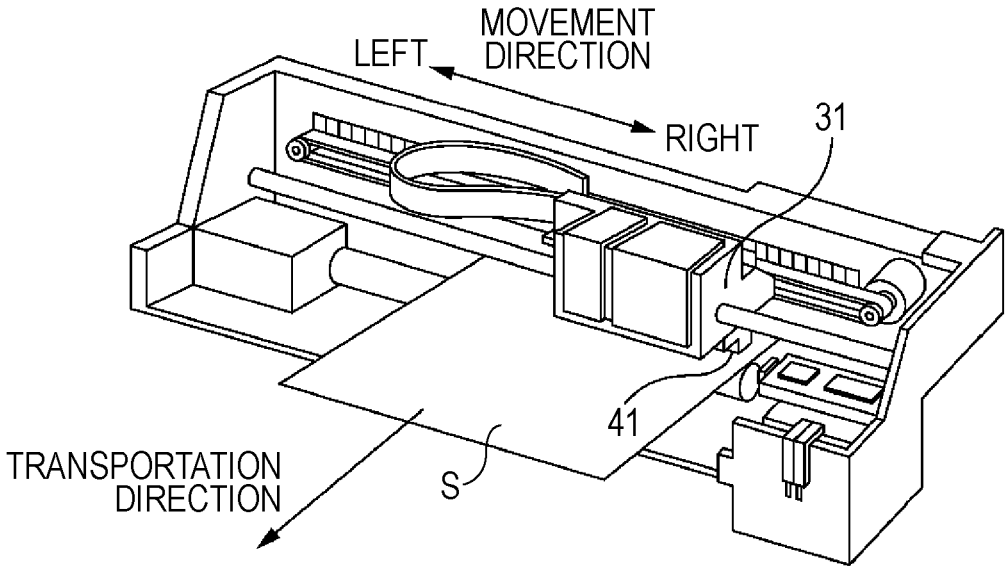
FIG. 2A is a perspective view that schematically illustrates an example of the appearance of a printer according to an exemplary embodiment of the invention.
Figure 2B:
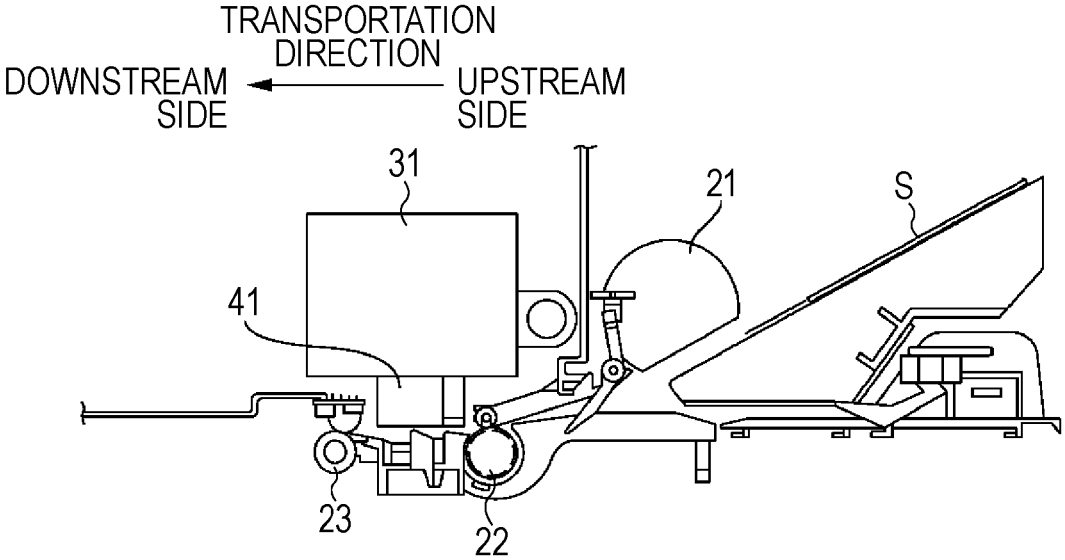
FIG. 2B is a sectional view of a printer according to an exemplary embodiment of the invention.

FIG. 1 is a block diagram that schematically illustrates an example of the overall configuration of the printer 1 according to an exemplary embodiment of the invention. FIG. 2A is a perspective view that schematically illustrates an example of the appearance of the printer 1. FIG. 2B is a sectional view of the printer 1. The printer 1 receives print data from a computer 60, which is an external device. Upon receiving the print data, a controller 10 of the printer 1 controls a transportation unit 20, a carriage unit 30, and a head unit 40 to form an image on a print target medium S (e.g., a sheet of printing paper, film, or the like). A plurality of detectors 50 monitors the internal operation state of the printer 1. On the basis of the result of detection, the controller 10 controls the inner components 20, 30, and 40 of the printer 1.

The controller 10 (controlling section) is a controlling unit, which controls the operation of the printer 1. An interface unit 11 is used for performing data transmission/reception between the computer 60 and the printer 1. A CPU 12 is a central processing unit that performs arithmetic processing for controlling the entire operation of the printer 1. A memory 13 provides a memory area for storing programs, a work area, and the like for the operation of the CPU 12. In accordance with a program stored in the memory 13, the CPU 12 controls each unit through a unit controlling circuit 14.

A transportation unit 20 (transportation mechanism) is a unit that picks up the print target medium S and then feeds it to a position where an image can be printed thereon. In addition, the transportation unit 20 transports the print target medium S in a transportation direction (predetermined direction) by predetermined transportation amount during printing. The transportation unit 20 includes a paper-feed roller 21, a transportation roller 22, and a paper-eject roller 23. The paper-feed roller 21 is rotated to feed a sheet of the print target medium S on which an image is to be printed to the transportation roller 22. The controller 10 causes the transportation roller 22 to rotate to set the position of the print target medium S for starting printing operation (i.e., at a print start position). The carriage unit 30 (movement mechanism) is a unit that moves a head 41 in the direction that is orthogonal to the transportation direction (hereinafter referred to as "movement direction"). The carriage unit 30 includes a carriage 31.

The head unit 40, which includes the head 41, is a unit that ejects ink onto the print target medium S. The head 41 travels in the movement direction together with the carriage 31. A plurality of nozzles is formed through the bottom plate of the head 41. The nozzles function as openings from which ink is ejected. An ink chamber, which is a compartment in which ink can be retained, is formed for each of the nozzles. The ink compartments are not illustrated in the drawing.

Figure 3:
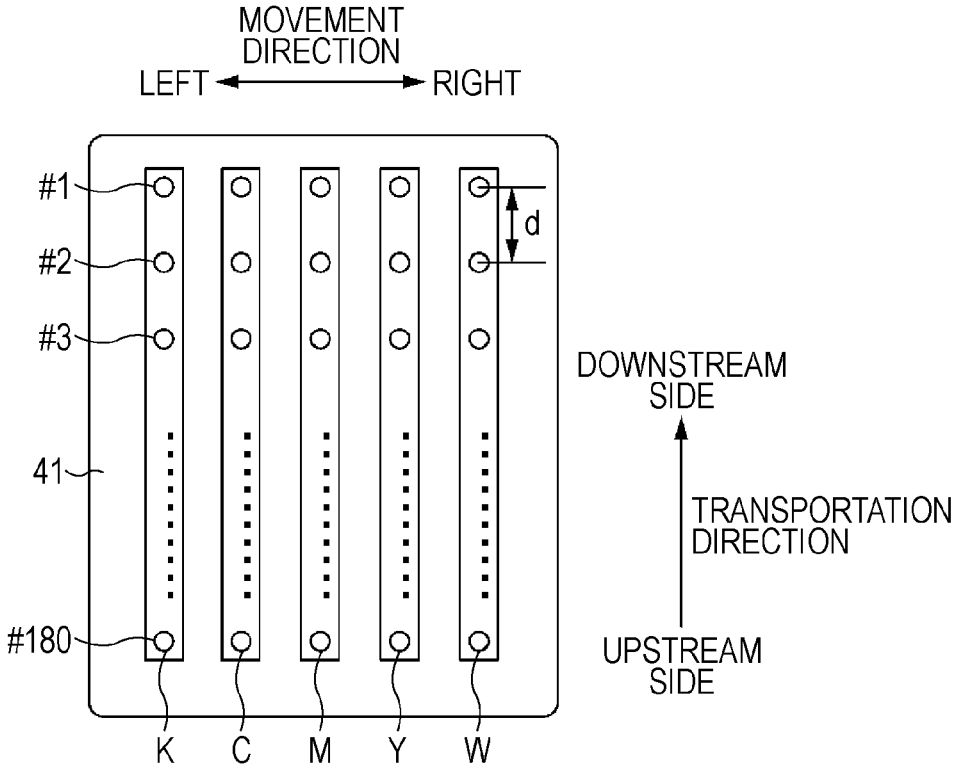
FIG. 3 is a diagram that schematically illustrates an example of the arrangement of nozzles formed in the bottom surface of a head.

FIG. 3 is a diagram that schematically illustrates an example of the arrangement of nozzles formed in the bottom surface of the head 41. Five lines of nozzles are formed in the bottom surface of the head 41. Each of the nozzle lines is made up of one hundred and eighty nozzles that are arranged at predetermined intervals (hereinafter referred to as "nozzle pitch d"). As illustrated in FIG. 3, a black ink nozzle line K, a cyan ink nozzle line C, a magenta ink nozzle line M, a yellow ink nozzle line Y, and a white ink nozzle line W are arranged from the left to the right in this order in the movement direction. Black ink is ejected from the black nozzle line K. Cyan ink is ejected from the cyan nozzle line C. Magenta ink is ejected from the magenta nozzle line M. Yellow ink is ejected from the yellow nozzle line Y. White ink is ejected from the white nozzle line W. For the purpose of explanation, serial numbers are assigned to these one hundred and eighty nozzles of each nozzle line in ascending order from the downstream side to the upstream side in the transportation direction (#1 to #180).

The printer 1 having the configuration described above performs dot formation processing and medium transportation processing repeatedly. In the dot formation processing, the printer 1 discharges ink droplets from the head 41, which travels in the movement direction, intermittently to form dots on a print target medium. In the medium transportation processing, the printer 1 transports the print target medium in the transportation direction to change the position of the print target medium relative to the position of the head 41. The medium transportation processing is an example of transportation operation according to an aspect of the invention. The repeated operation explained above makes it possible to form dots at a certain position (i.e., area) on a print target medium that is not the same as a position where dots have already been formed thereon as a result of preceding execution of the dot formation processing, thereby forming a two-dimensional image on the print target medium. In this specification, the traveling of the head 41 in the movement direction once while discharging ink droplets is defined as "pass". The pass corresponds to the execution of the dot formation processing once. The dot formation processing is an example of image formation operation according to an aspect of the invention.

Method for Printing Two Images in Layers

Printed Matter

In the following description, a printed matter that includes a color image that is formed by means of ink of four colors (YMCK) on a white background image is taken as an example of a printed matter that includes two images one of which is printed on the other. Even when an image is printed on a transparent film, such a printed matter prevents the opposite face thereof from being seen therethrough. In addition, such a printed matter makes it possible to print an image having excellent color development property.

If a white background image is printed with the use of white ink only, the color of the white ink determines the color of the background image. Strictly speaking, the colors of ink called roughly as white ink actually differ from one to another. For this reason, in some cases, it is practically impossible to print a desired white image by using white ink only.

In view of the above fact, in the present embodiment of the invention, white ink only is used to print a background image at every area where an overlapping color image will be printed thereon in the entire area of the background image. This area is hereinafter referred to as "overlapping white area". On the other hand, ink of four colors (YMCK) is used as may be necessary in addition to white ink to print the background image at every area where no overlapping color image will be printed thereon in the entire area of the background image. This area is hereinafter referred to as "non-overlapping white area". In this way, a desired white background image is printed. The above image formation makes it possible to ensure that the color of the exposed white part of the background image that an observer can see, that is, the color of the non-overlapping white area, is the desired white. Since an observer cannot see the overlapping white area when it is observed from the printed-face side, white ink only is used for printing at the overlapping white area. By this means, it is possible to reduce the amount of consumption of ink. However, the scope of the invention is not limited to such an example. Color ink may be mixed with white ink for printing the non-exposed white part of the background image at the overlapping white area in the same manner as done at the non-overlapping white area.

In this specification, the meaning of the term "white" is not limited to white in its technically strict sense, which is the color of a surface of an object that perfectly reflects visible light of all wavelengths (100%). The term "white" used in this specification has a broader meaning that encompasses colors that are deemed as white from common sense. It includes but not limited to whitish or white-tinged colors. In the following description, the adjustment of white by mixing ink of a certain color(s) other than white in (or with) white ink is referred to as "white adjustment". The color that is produced as a result of the white adjustment (i.e., white having been subjected to the white adjustment) is referred to as "adjusted white".

In the present embodiment of the invention, when two images are printed in layers, that is, with one of the two images being printed on the other, both the white ink nozzle line W and the four-color ink nozzle line YMCK are used to print a background image having the color of adjusted white at a certain area of the print target medium S in a preceding set of passes. Thereafter, the four-color ink nozzle line YMCK only are used to print a color image on the background image at the same area in a succeeding set of passes. The white ink nozzle line W is an example of a first nozzle line according to an aspect of the invention. The four-color ink nozzle line YMCK is an example of a second nozzle line according to an aspect of the invention. In this way, the color image is printed on the background image. In the following description, the yellow ink nozzle line Y, the magenta ink nozzle line M, the cyan ink nozzle line C, and the black ink nozzle line K are collectively referred to as "color nozzle line Co". The white ink nozzle line is referred to as "white nozzle line W".

Printing Method without Drying Pass

Figure 4:
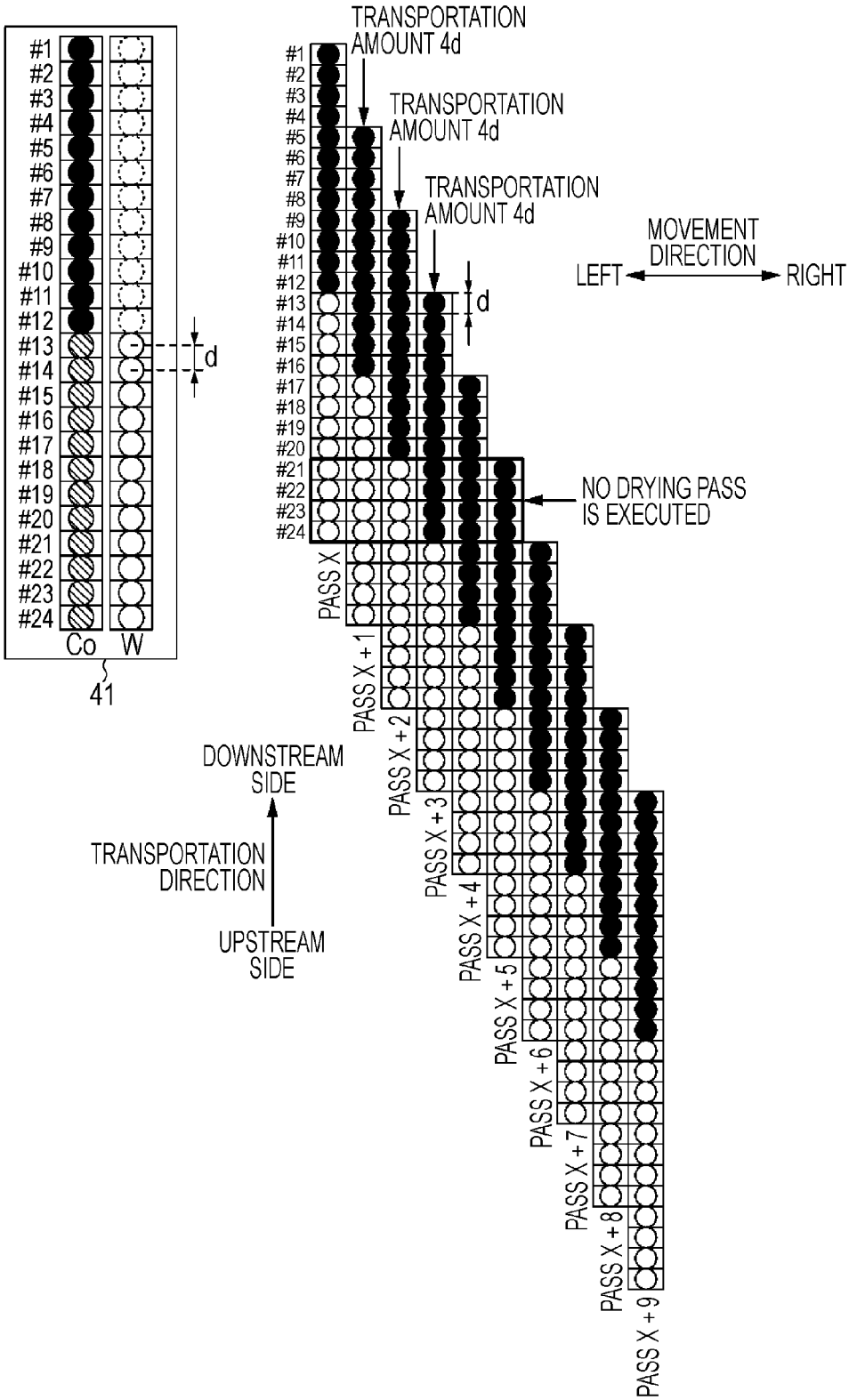
FIG. 4 is a diagram that schematically illustrates an example of a printing method used when long time for drying a background image is not required.

FIG. 4 is a diagram that schematically illustrates an example of a printing method used when long time for drying a background image is not required. To simplify explanation, in the accompanying drawings, the number of nozzles that belong to a nozzle line is reduced (nozzles #1 to #24 in FIG. 4). As illustrated in the left part of FIG. 4, nozzles that are used for printing a background image having the color of adjusted white are denoted as white circles (○) in the white nozzle line W and shaded circles in the color nozzle line Co (=YMCK). Nozzles that are used for printing a color image are denoted as black circles (●) in the color nozzle line Co. The right part of FIG. 4 shows the positions of ink ejection nozzles in each pass and their relative positions in the passes, where the same nozzles that are used for printing a background image (○) and the same nozzles that are used for printing a color image (●) are shown therein. Note that the positions of nozzles that are used for printing a background image and belong to the white nozzle line W are the same as the positions of nozzles that are used for printing the background image and belong to the color nozzle line Co. Therefore, the white-circle symbol (○) is used in the drawing to collectively represent each of the nozzles that are used for printing the background image.

When printing is performed near the upper edge of a print target medium or the lower edge thereof, the number of nozzles from which ink droplets are discharged is usually changed. Alternatively, or in addition thereto, the amount of transportation of the print target medium is changed. FIG. 4 shows a normal non-edge printing state (passes X to X+9), which means that printing is performed at an area that is not near the upper edge of a print target medium nor the lower edge thereof. Therefore, in the illustrated example, it is assumed that both the number of nozzles from which ink droplets are discharged and the amount of transportation of a print target medium are constant.

To print a color image in a succeeding set of passes after the printing of a background image at the same area on a print target medium, one half of nozzles belonging to the white nozzle line W at the upstream side in the transportation direction (nozzles #13 to #24) are set as nozzles from which ink droplets are discharged (hereinafter referred to as "active ejection nozzles"), whereas the other half of nozzles belonging to the white nozzle line W at the downstream side in the transportation direction (nozzles #1 to #12) are set as nozzles from which no ink droplet is discharged (defined as "inactive nozzles"). On the other hand, one half of nozzles belonging to the color nozzle line Co at the downstream side in the transportation direction (nozzles #1 to #12) are set as active ejection nozzles used for printing the color image, whereas the other half of nozzles belonging to the color nozzle line Co at the upstream side in the transportation direction (nozzles #13 to #24) are set as active ejection nozzles used in combination with the nozzles #13 to #24 belonging to the white nozzle line W for printing the background image.

Since the active ejection nozzles of the color nozzle line Co and the white nozzle line W are set as explained above, a certain area of a print target medium first arrives at a position where the area faces the active ejection nozzles of the nozzle lines W and Co formed at the upstream side in the transportation direction (nozzles #13 to #24). As a result, a background image having the color of adjusted white is printed thereat. Thereafter, the above area of the print target medium moves downstream due to transportation to face the active ejection nozzles of the color nozzle line Co formed at the downstream side in the transportation direction (nozzles #1 to #12). As a result, a color image is printed on the background image.

In the illustrated example of FIG. 4, an overlap print scheme is used to produce a printed matter that includes a background image and a color image that are formed in layers. In the overlap printing, a plurality of passes (i.e., a plurality of nozzles) forms one raster line. The raster line is a line of dots arranged in the movement direction. By this means, it is possible to reduce the influence of variation in the characteristics of nozzles, thereby outputting a print image in high quality. Herein, it is assumed that the number of active ejection nozzles in a nozzle line for printing each of a background image and a color image is twelve. In addition, it is assumed that each image is formed as a result of three passes. Under these assumptions, the transportation amount of a print target medium in each execution (i.e., a single execution) of transportation operation is equal to the width of an image formed by means of four nozzles, which is four times as large as the nozzle pitch d (i.e., 4*d*). The length of each quadrangular cell (i.e., a box in which the symbol of a nozzle is shown) in the transportation direction in FIG. 4 corresponds to the nozzle pitch d. In FIG. 4, since the transportation amount of a print target medium in each execution of transportation operation is 4*d*, the positions of nozzles in a certain pass is shifted from the position of the nozzles in the preceding pass (the next pass) by shift amount corresponding to four quadrangular cells.

As described above, the printer 1 performs image formation operation by discharging ink droplets from the twelve upstream active ejection nozzles of the white nozzle line W, the twelve upstream active ejection nozzles of the color nozzle line Co, and the twelve downstream active ejection nozzles of the color nozzle line Co. The printer 1 performs transportation operation in which a print target medium is transported by unit amount that is four times as large as the nozzle pitch d (i.e., 4*d*). The image formation operation and the transportation operation are repeated alternately. By this means, the printer 1 can print a background image in a preceding set of three passes and print a color image on the background image in a succeeding set of three passes.

In the right part of FIG. 4, six nozzles that are aligned in the movement direction form one raster line. As shown at a part enclosed by a thick-bordered box in the drawing, printing for four raster lines is completed at each execution of transportation operation. One can understand from this drawing that the printing of each of a background image and a color image is completed as a result of pass execution three times. Specifically, in the four raster lines formed by the nozzles shown inside the thick-line box, dots for a background image are formed in a preceding set of three passes X, X+1, and X+2. Thereafter, dots for a color image are formed in a succeeding set of three passes X+3, X+4, and X+5.

In the illustrated example of FIG. 4, all nozzles (#1 to #24) that belong to each nozzle line W, Co are set as active ejection nozzles, that is, nozzles used for image formation. This means that there is not any nozzle from which an ink droplet is not discharged between the active ejection nozzles set for a color image (nozzles #1 to #12 in Co) and the active ejection nozzles set for a background image (nozzles #13 to #24 in W, Co). Therefore, upon the completion of the printing of a background image at a certain area of a print target medium, the printing of a color image thereat starts in the next pass without delay. As will be understood by referring to the nozzles shown inside the thick-line box in the right part of FIG. 4, the printing of a color image starts in the next pass X+3 immediately after the completion of the printing of a background image in the pass X+2. Therefore, time from the end of the printing of the background image to the start of the printing of the color image, that is, time for drying the background image, is comparatively short; it is time required for a single execution of transportation operation only.

To dry background well, it is possible to set one or more passes in which image formation operation is not performed (hereinafter referred to as "drying pass") during time from the end of the printing of a background image to the start of the printing of a color image by setting some nozzles from which no ink droplet is discharged (hereinafter referred to as "drying nozzle") between active ejection nozzles for the color image and active ejection nozzles for the background image. A more detailed explanation thereof will be given later. However, in a case where white ink and color ink that are ejected before the printing of a color image have excellent drying property or where a print target medium has excellent ink-absorbing property, a background image dries easily. Therefore, it is not necessary to set long drying time in such a case. If long drying time is not necessary, as illustrated in FIG. 4, no drying nozzle is set between active ejection nozzles for a color image and active ejection nozzles for a background image. Since no nozzle is allocated for drying, nozzles that belong to a nozzle line can be utilized efficiently. In addition, since no drying pass, which does not contribute to image formation, is set, it is possible to shorten printing time. To put it the other way around, printing time can be shortened because the number of nozzles that contribute to image formation is relatively large.

Printing Method with Drying Pass According to Comparative Example

In a case where white ink and color ink that are ejected before the printing of a color image have poor drying property or where a print target medium has poor ink-absorbing property, a background image does not dry easily. In such a case, if the printing of a color image is started in the next pass immediately after the completion of the printing of a background image in a certain pass as done in the printing method illustrated in FIG. 4, ink runs thereon to deteriorate image quality. To avoid ink from running thereon when a background image does not dry easily, it is effective to set one or more drying passes, that is, one or more passes in which image formation operation is not performed, during time from the end of the printing of the background image to the start of the printing of a color image. A printing method with a drying pass (passes) according to a comparative example is explained below.

Figure 5:
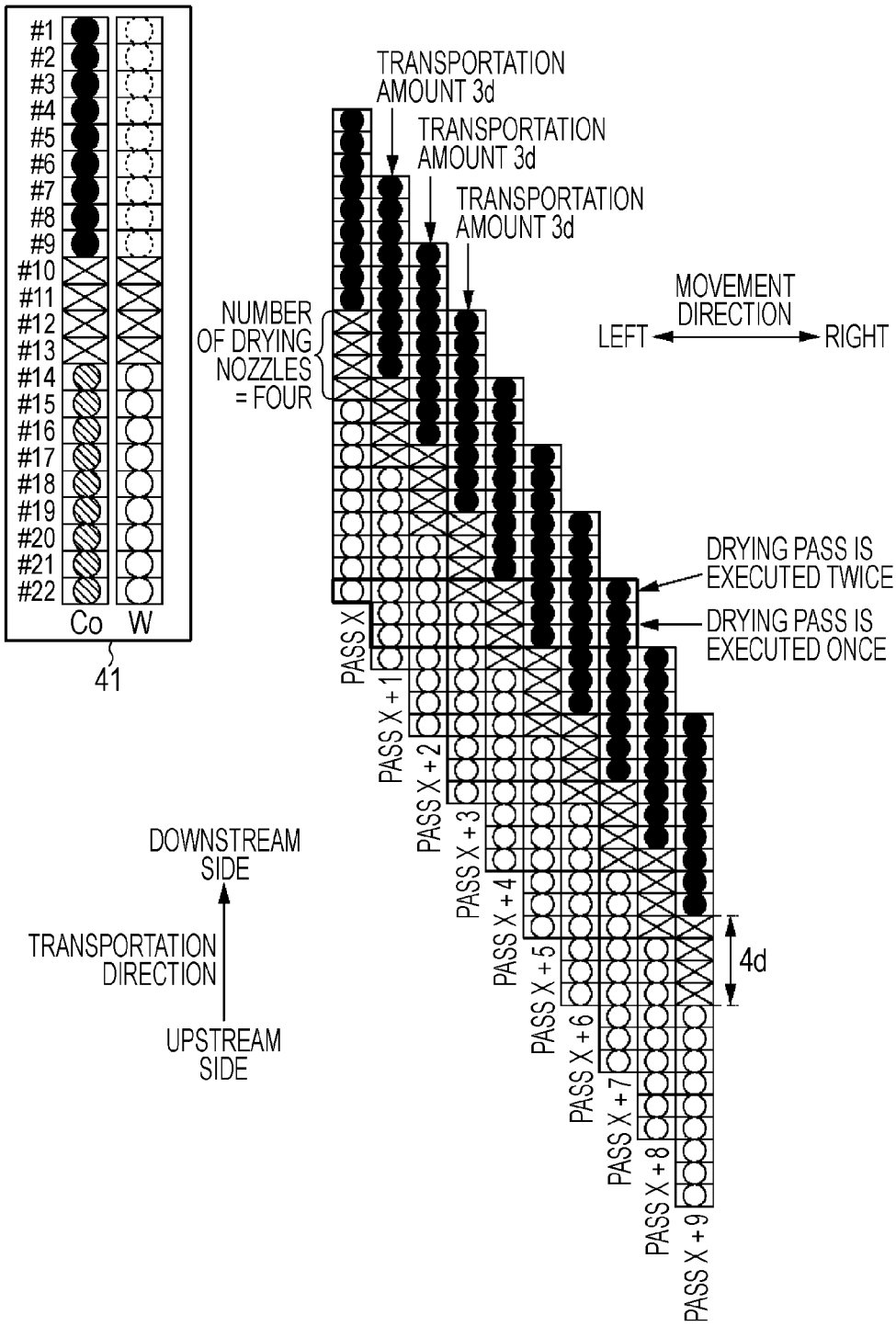
FIG. 5 is a diagram that schematically illustrates a printing method with drying pass according to a comparative example.

FIG. 5 is a diagram that schematically illustrates a printing method with drying pass according to a comparative example. In FIG. 5, nozzle configuration is assumed as follows. The number of nozzles that belong to a nozzle line is twenty-two. Nine nozzles belonging to each of the white nozzle line W and the color nozzle line Co at the upstream side in the transportation direction (nozzles #14 to #22) are set as nozzles that are used for printing a background image having the color of adjusted white. Nine nozzles belonging to the color nozzle line Co at the downstream side in the transportation direction (nozzles #1 to #9) are set as nozzles that are used for printing a color image. In addition, it is assumed that the number of passes for printing each of the background image and the color image is three (i.e., three times). The transportation amount of a print target medium in each execution of transportation operation is equal to the width of an image formed by means of three nozzles, which is three times as large as the nozzle pitch d (i.e., 3*d*).

In addition, the remaining four nozzles (#10 to #13), which are located upstream of the nine nozzles (#1 to #9) for printing a color image (color nozzle line Co) in the transportation direction and downstream of the nine nozzles (#14 to #22) for printing a background image (white nozzle line W, color nozzle line Co) in the transportation direction, are set as drying nozzles (i.e., nozzles from which no ink droplet is discharged) in each of the nozzle lines W and Co. The drying nozzle is denoted as a cross (×) in the drawing. In other words, the nozzles (#10 to #13) located between the active ejection nozzles for a color image (#1 to #9) and the active ejection nozzles for a background image having the color of adjusted white (#14 to #22) in a nozzle line (#1 to #22) are set as drying nozzles. With the above nozzle configuration, it is possible to set a drying pass (passes), that is, a pass in which image formation operation is not performed, during time from the end of the printing of the background image to the start of the printing of the color image. The drying pass makes it possible to prevent ink used for printing the color image from running on the background image, which would otherwise deteriorate image quality.

Printing operation is explained below. A certain area of a print target medium first arrives at a position where the area faces the active ejection nozzles of the white nozzle line W and the color nozzle line Co formed at the upstream side in the transportation direction (denoted as white circles and shaded circles, respectively). As a result, a background image is printed thereat. Then, the above area of the print target medium moves downstream due to transportation to face the drying nozzles (denoted as crosses). Therefore, no ink droplet is discharged onto the background image at this position. The background image dries during this time period. Thereafter, the above area of the print target medium moves downstream due to transportation to face the active ejection nozzles of the color nozzle line Co formed at the downstream side in the transportation direction (denoted as black circles). As a result, a color image is printed on the background image.

In a printing method according to the above comparative example, printing for three raster lines is completed at each execution of transportation operation. The nozzles enclosed by thick lines in the right part of FIG. 5 form these three raster lines. In the right part of FIG. 5, nozzles that are aligned in the movement direction form a raster line. The white circle shown therein (○) denotes each of nozzles that are used for printing a background image. The black circle shown therein (●) denotes each of nozzles that are used for printing a color image. In each of the three raster lines formed by the nozzles shown inside the thick lines, three nozzles (three passes) of each of the white nozzle line W and the color nozzle line Co form dots for a background image, whereas three nozzles (three passes) of the color nozzle line Co form dots for a color image.

As will be understood by referring to the nozzles shown inside the thick lines in the right part of FIG. 5, in the raster line formed as an "array" of the nozzles at the most downstream side in the transportation direction, the background image is printed in the passes X, X+1, and X+2. In this most downstream raster line, the color image is printed in the passes X+5, X+6, and X+7. Therefore, the number of drying passes is two (i.e., twice). In contrast, in the raster line formed as the uppermost array of the nozzles in the transportation stream and the raster line formed as the second uppermost array of the nozzles inside the above thick lines, the background image is printed in the passes X+1, X+2, and X+3; the color image is printed in the passes X+5, X+6, and X+7. Therefore, drying pass is executed just once. As explained above, in a printing method according to the above comparative example, the number of times of drying-pass execution differs depending on raster line. In other words, if a printing method according to the above comparative example is used, the length of time for drying a background image is not constant during printing. If the length of the background drying time is not constant, the degree of the dryness of a background image (white ink and color ink) is not uniform when a color image is printed on the background image, which results in the different degree of the running of ink. For this reason, the depth of shade of an image obtained will not be uniform.

In a printing method according to the above comparative example, the transportation amount of a print target medium in each execution of transportation operation is equal to the width of an image formed by means of three nozzles, which is three times as large as the nozzle pitch d, that is, 3*d* (three quadrangular cells). On the other hand, the number of drying nozzles in a nozzle line is set as four. In addition, the length of a dry area, which means a nozzle area where the drying nozzles are located, in the transportation direction is four times as great as the nozzle pitch d, that is, 4*d* (four quadrangular cells). For this reason, the number of times of drying-pass execution could differ from one raster line to another. That is, in the above comparative example, the length of the nozzle area where the drying nozzles are located (i.e., the length of a line of nozzles that are not used for forming an image) in the transportation direction, which is 4*d*, is not an integral multiple of the transportation amount of a print target medium in each execution of transportation operation, which is 3*d* (×4/3).

In FIG. 5, as explained above, the length of the dry area in the transportation direction (4*d*) is not an integral multiple of the unit transportation amount of a print target medium (3*d*); in addition, the number of drying nozzles in a nozzle line (four) is larger than the number of nozzles corresponding to amount by which the positions of nozzles relative to the position of the print target medium are shifted in each execution of transportation operation (three). Therefore, after the printing of a background image at a certain area of a print target medium, the area moves downstream due to transportation to face the four drying nozzles. In the next transportation operation, the print target medium is transported downstream by the unit transportation amount corresponding to three nozzles (3*d*). As a result, the part of the print target medium that faced the downstream-side three of the four drying nozzles, which do not include the uppermost one in the transportation stream, moves to face the active ejection nozzles of the color nozzle line Co for printing a color image, whereas the part of the print target medium that faced the uppermost drying nozzle in the transportation stream moves to face a drying nozzle again. Consequently, drying pass is executed just once for some raster lines (i.e., the part of the print target medium that faced the downstream-side three drying nozzles), whereas drying pass is executed twice for another raster line (i.e., the part of the print target medium that faced the uppermost drying nozzle in the transportation stream). For this reason, the number of times of drying-pass execution differs depending on raster line.

A case where a difference in the number of times of drying-pass execution (i.e., the length of time for drying a background image) depending on raster line arises is not limited to the above example. Though not illustrated in the drawing, it differs depending on raster line in a case where the number of drying nozzles is smaller than the number of nozzles corresponding to amount by which the positions of nozzles relative to the position of the print target medium are shifted in each execution of transportation operation (e.g., in a case where the length of the nozzle area where the drying nozzles are located in the transportation direction is one third or two thirds of transportation amount). For example, let the number of drying nozzles be two. Let the number of nozzles corresponding to amount by which the positions of nozzles relative to the position of a print target medium are shifted in each execution of transportation operation be three. In this example, when a certain area of a print target medium on which a background image has been printed moves downstream due to transportation by the transportation amount corresponding to three nozzles, though the upstream part of the area of the print target medium faces the two drying nozzles, the downstream part of the area thereof faces an active ejection nozzle of the color nozzle line Co for printing a color image without facing either of the two drying nozzles. Therefore, the same image contains a part printed with a drying pass and a part printed without a drying pass, which causes non-uniformity in the depth of shade.

To sum up, in a printing method according to the above comparative example, since the length of a nozzle area where drying nozzles are located in the transportation direction (or the number of the drying nozzles) is not an integral multiple of the unit transportation amount of a print target medium (or the number of nozzles corresponding to amount by which the positions of nozzles relative to the position of the print target medium are shifted in each execution of transportation operation), the length of time for drying a background image (i.e., the number of times of drying-pass execution) is not constant. For this reason, the depth of shade of an image obtained will not be uniform. In view of the above, the present embodiment of the invention aims to make time from the end of the printing of a background image to the start of the printing of a color image at a certain area of a print target medium (the length of time for drying the background image, the number of times of drying-pass execution) constant.

Figure 6:
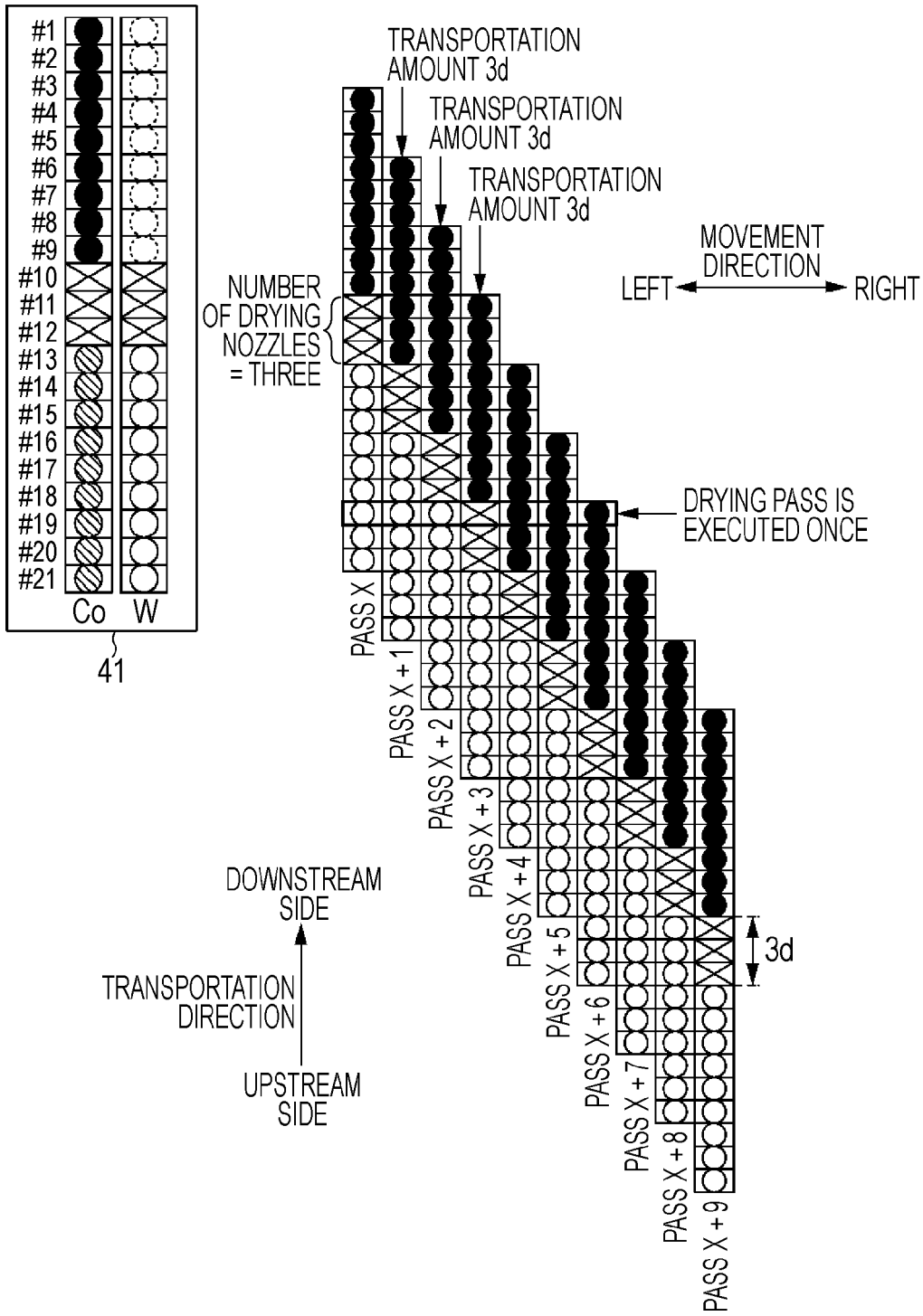
FIG. 6 is a diagram that schematically illustrates an example of a printing method with drying pass according to an exemplary embodiment of the invention.

Printing Method with Drying Pass According to Present Embodiment of the Invention FIG. 6 is a diagram that schematically illustrates an example of a printing method with drying pass according to an exemplary embodiment of the invention. In FIG. 6, nozzle configuration is assumed as follows. The number of nozzles that belong to a nozzle line is twenty-one. Nine nozzles belonging to each of the white nozzle line W (denoted as white circles) and the color nozzle line Co (denoted as shaded circles) at the upstream side in the transportation direction (nozzles #13 to #21) are set as nozzles (active ejection nozzles) that are used for printing a background image having the color of adjusted white. Nine nozzles belonging to the color nozzle line Co (denoted as black circles) at the downstream side in the transportation direction (nozzles #1 to #9) are set as nozzles (active ejection nozzles) that are used for printing a color image. In addition, it is assumed that the number of passes for printing each of the background image and the color image is three (i.e., three times). The transportation amount of a print target medium in each execution of transportation operation is equal to the width of an image formed by means of three nozzles, which is three times as large as the nozzle pitch d (i.e., 3*d*).

In addition, in order to set a drying pass during time from the end of the printing of the background image to the start of the printing of the color image, the remaining three nozzles (#10, #11, and #12), which are located upstream of the active ejection nozzles (#1 to #9) of the color nozzle line Co for printing the color image in the transportation direction and downstream of the active ejection nozzles (#13 to #21) of the white nozzle line W and the color nozzle line Co for printing the background image in the transportation direction, are set as drying nozzles (i.e., nozzles from which no ink droplet is discharged) in each of the nozzle lines W and Co. That is, the length of the nozzle area where the drying nozzles are located in the transportation direction corresponds to three nozzles, which is three times as great as the nozzle pitch d, that is, 3*d* (three quadrangular cells). To sum up, in a printing method according to the present embodiment of the invention, the length of the nozzle area where the drying nozzles are located in the transportation direction, 3*d*, is equal to (which is a kind of an integral multiple of) the transportation amount of a print target medium in each execution of transportation operation, 3*d*. In other words, the number of the drying nozzles (three) is an integral multiple of (equal to, ×1) the number of nozzles corresponding to amount by which the positions of nozzles relative to the position of a print target medium are shifted in each execution of transportation operation (three).

Printing operation according to the present embodiment of the invention is explained below. A certain area of a print target medium (e.g., an area where three raster lines will be formed) moves downstream due to transportation by the transportation amount corresponding to three nozzles at a time. In each pass, the area faces three of the active ejection nozzles set for the background image (#13 to #24). Three passes complete the printing of the background image. In the next transportation operation, the area moves downstream to face the three drying nozzles (#10, #11, and #12). The background image dries during this time period. Thereafter, the area moves downstream due to transportation to face three of the active ejection nozzles set for the color image (#1 to #9) in each pass. Three passes complete the printing of the color image. By this means, it is possible to make the number of times of drying-pass execution at the above area of the print target medium during time from the end of the printing of the background image to the start of the printing of the color image constant. That is, drying pass is executed once in a uniform manner. Thus, it is possible to prevent the number of times of drying-pass execution from being different from one raster line to another.

For example, the nozzles arranged in the movement direction inside the thick lines in the right part of FIG. 6 include three active ejection nozzles set for a background image (○) (W and Co), one drying nozzle (×), and three active ejection nozzles set for a color image (●) (Co). One can understand from this drawing that the number of times of drying-pass execution is one. Specifically, in the raster line formed by the nozzles shown inside the thick lines, dots for a background image are formed in a preceding set of three passes X, X+1, and X+2. Then, drying pass is executed once (X+3). Thereafter, dots for a color image are formed in a succeeding set of three passes X+4, X+5, and X+6. The above raster configuration is not unique to the nozzles shown inside the thick lines. Each of the other arrays of nozzles in the movement direction includes three active ejection nozzles set for the background image (○), one drying nozzle (×), and three active ejection nozzles set for the color image (●). Accordingly, one can understand that, in each raster line, dots for the background image are formed in three passes, then, drying pass is executed once, thereafter, dots for the color image are formed in three passes, and thus that the number of times of drying-pass execution does not differ from one raster line to another (that is, it is executed once). That is, it is possible to ensure that the length of time for drying a background image (the number of times of drying-pass execution) is constant during the printing of a single image.

As explained above, in a printing method according to the present embodiment of the invention, the length of a nozzle area where drying nozzles are located in the transportation direction (or the number of the drying nozzles), which is 3*d*, is an integral multiple of the unit transportation amount of a print target medium (or the number of nozzles corresponding to amount by which the positions of nozzles relative to the position of the print target medium are shifted in each execution of transportation operation), which is 3*d*. More specifically, in the illustrated example of FIG. 6, the former is equal to (×1) the latter. Therefore, the length of time for drying a background image (i.e., the number of times of drying-pass execution) is constant throughout the same single image. For this reason, the depth of shade of an image obtained will be uniform.

Figure 7:
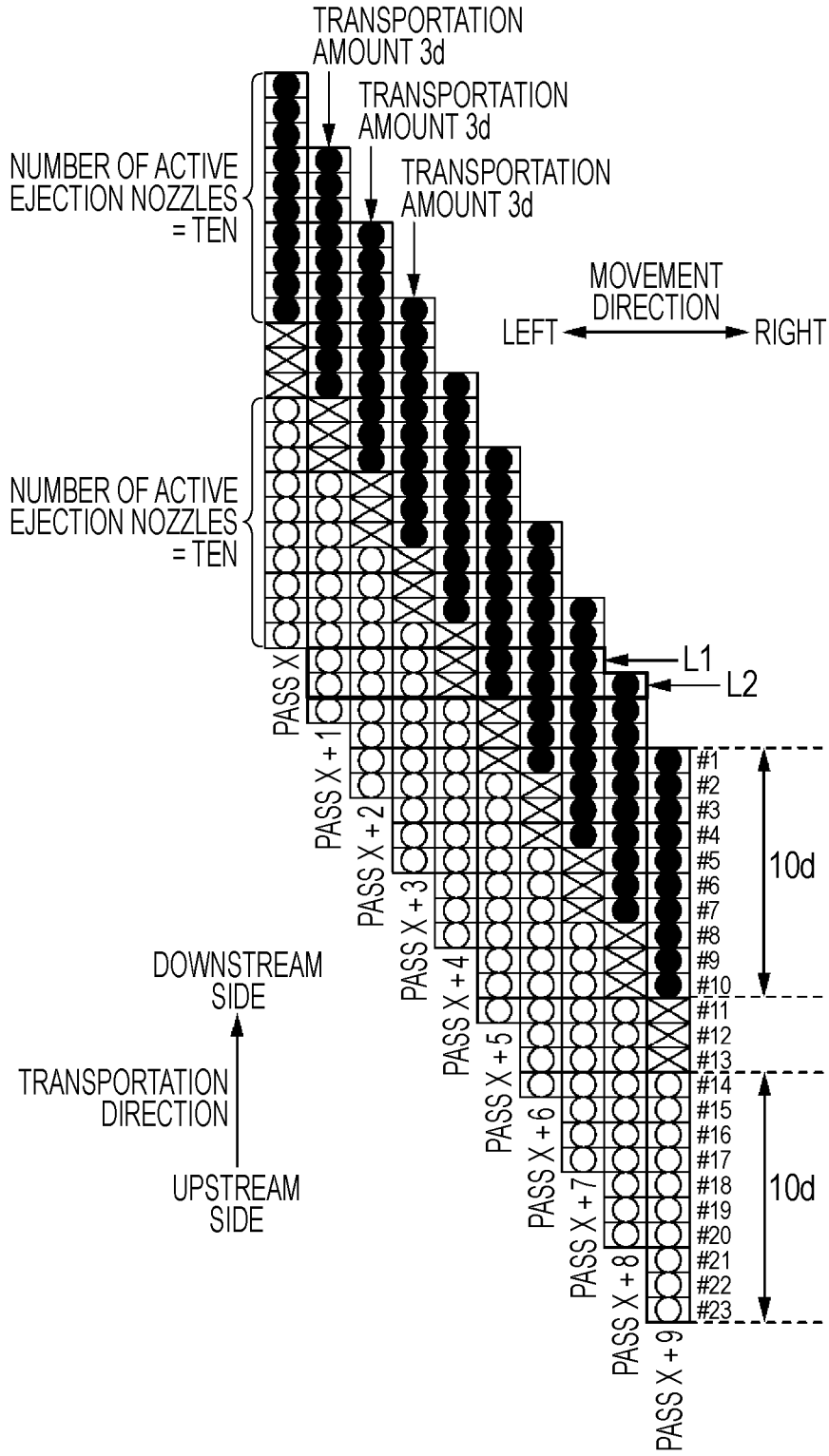
FIG. 7 is a diagram that schematically illustrates an example of a printing method in which the number of passes for forming a background image (or a color image) varies.

FIG. 7 is a diagram that schematically illustrates an example of a printing method in which the number of passes for forming a background image (or a color image) varies. In FIG. 7, it is assumed that the number of drying nozzles (#11, #12, and #13) is three. In addition, it is assumed that the transportation amount of a print target medium in each execution of transportation operation is three times as large as the nozzle pitch d. That is, the length of the nozzle area where the drying nozzles are located in the transportation direction, 3*d*, is an integral multiple of (equal to, ×1) the unit transportation amount of a print target medium, 3*d*. Accordingly, in each array of nozzles in the movement direction in FIG. 7, one drying nozzle (×) is set between nozzles used for printing a background image (○) (W and Co) and nozzles used for printing a color image (●) (Co). Therefore, the number of times of drying-pass execution does not differ from one raster line to another (that is, it is executed once).

In FIG. 6, the length of a nozzle area where active ejection nozzles for forming a background image (or a color image) are located in the transportation direction, which is 9*d* (nine quadrangular cells), is an integral multiple of (i.e., three times as large as) the transportation amount of a print target medium, which is 3*d* (three quadrangular cells). In other words, the number of the active ejection nozzles for forming an image (a background image or a color image) in a nozzle line (nine) is an integral multiple of (×3) the number of nozzles corresponding to amount by which the positions of nozzles relative to the position of a print target medium are shifted in each execution of transportation operation (three). Therefore, the number of passes for printing a background image (or a color image) is constant (three) throughout the same image.

In contrast, in FIG. 7, ten active ejection nozzles belonging to each of the white nozzle line W and the color nozzle line Co at the upstream side in the transportation direction (#14 to #23) are used for printing a background image. Ten active ejection nozzles belonging to the color nozzle line Co at the downstream side in the transportation direction (#1 to #10) are used for printing a color image. That is, the length of a nozzle area where active ejection nozzles for forming an image (a background image or a color image) are located in the transportation direction, which is 10*d* (ten quadrangular cells), is not an integral multiple of (×10/3) the transportation amount of a print target medium, which is 3*d* (three quadrangular cells).

For this reason, as illustrated in FIG. 7, the number of passes for forming a background image (or a color image) in some raster lines is three, whereas the number of passes for forming the background image (or the color image) in other raster lines is four. For example, a group of nozzles (nozzles arranged in the movement direction) that form a raster line L1 shown in FIG. 7 include three nozzles for a background image (○) and three nozzles for a color image (●). Each of the background image and the color image is printed as a result of pass execution three times. In contrast, a group of nozzles that form a raster line L2 include three nozzles for the background image (○) and four nozzles for the color image (●). The background image is printed in three passes, whereas the color image is printed in four passes. That is, the number of passes for forming the color image in the raster line L1 is different from that in the raster line L2.

For example, a certain area of a print target medium where three raster lines will be formed moves downstream due to transportation by the transportation amount corresponding to three nozzles at a time. The area faces the active ejection nozzles set for the background image (○) (W and Co) in three passes. As a result of the next transportation operation, the downstream part of the area faces the drying nozzles (×), whereas the upstream part of the area faces an active ejection nozzle set for the background image (○) again. That is, the background image is printed in three passes at the downstream part of the area, whereas the background image is printed in four passes at the upstream part of the area. As explained above, if the length of a nozzle area where active ejection nozzles are located in the transportation direction is not an integral multiple of the transportation amount of a print target medium, the number of passes for printing an image (a background image or a color image) differs depending on raster line.

If the number of passes for printing an image in some raster lines is different from that in other raster lines, complex processing for assigning dots for raster-line formation to passes (nozzles) is required when print data is created. For the purpose of further explanation, it is assumed that no ink droplet is discharged from the nozzle corresponding to the pass X+5 among four color-image nozzles in the group of nozzles that form the raster line L2 shown in FIG. 7. If no ink droplet is discharged from the X+5 nozzle, drying pass is executed twice (i.e., passes X+4 and X+5). In such a case, the number of times of drying-pass execution for the raster line L2 is different from that for the other raster lines (once). Therefore, the depth of shade of an image obtained will not be uniform. To avoid the number of times of drying-pass execution from being changed, the above assumption is modified; for example, it is assumed that no ink droplet is discharged from the nozzle corresponding to the pass X+8 in the group of nozzles forming the raster line L2 shown in FIG. 7. If no ink droplet is discharged from the X+8 nozzle, the number of active ejection nozzles changes despite the fact that printing is not being performed at the upper-edge region of a print target medium or the lower-edge region thereof, which requires more complex printing control.

To avoid the above disadvantages, it is preferable that not only the length of a nozzle area where drying nozzles are located in the transportation direction but also the length of a nozzle area where active ejection nozzles for forming a background image or a color image are located in the transportation direction should be an integral multiple of the unit transportation amount of a print target medium. With such a preferred configuration, the number of passes for forming each of the images becomes constant.

Figure 8:
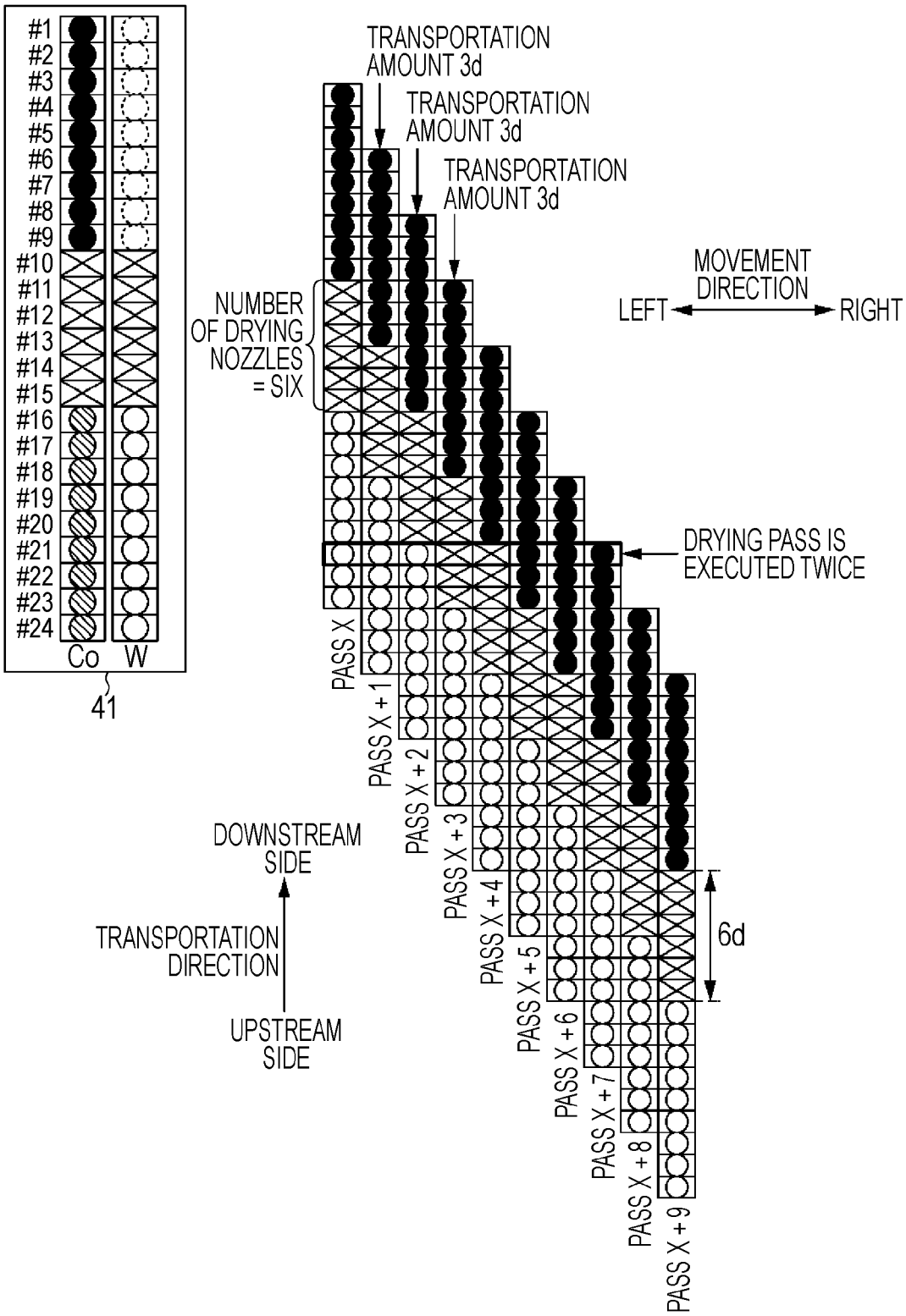
FIG. 8 is a diagram that schematically illustrates an example of a printing method for lengthening drying time.

FIG. 8 is a diagram that schematically illustrates an example of a printing method for lengthening drying time. In FIG. 8, nine nozzles belonging to each of the white nozzle line W and the color nozzle line Co at the upstream side in the transportation direction (#16 to #24) are set as active ejection nozzles for a background image. Nine nozzles belonging to the color nozzle line Co at the downstream side in the transportation direction (#1 to #9) are set as active ejection nozzles for a color image. The number of passes for printing each of the background image and the color image is three. The transportation amount of a print target medium in each execution of transportation operation is 3*d*, which is three times as large as the nozzle pitch d.

In order to make the length of background drying time greater than that of the printing method illustrated in FIG. 6, in the printing method illustrated in FIG. 8, six drying nozzles (#10 to #15) are set between the active ejection nozzles for the background image (#16 to #24) and the active ejection nozzles for the color image (#1 to #9) in a nozzle line (#1 to #24). That is, the length of the nozzle area where the drying nozzles are located in the transportation direction (or the number of the drying nozzles=six), which is 6*d*, is twice as large as the unit transportation amount of a print target medium (or the number of nozzles corresponding to amount by which the positions of nozzles relative to the position of a print target medium are shifted in each execution of transportation operation=three), which is 3*d*.

As the nozzles arranged in the movement direction inside the thick lines in the right part of FIG. 8 show, two drying nozzles (×) are set between three active ejection nozzles for a background image (○) and three active ejection nozzles for a color image (●). Therefore, drying pass is executed twice. Thus, drying time in the printing method illustrated in FIG. 8 is twice as long as that illustrated in FIG. 6. In comparison with the foregoing method in which drying pass is executed once, longer time is allowed for drying a background image.

When a plurality of images is printed in layers, time required for drying a lower-layer image differs depending on the drying property of ink ejected before the printing of an upper-layer image or the ink-absorbing property of a print target medium. Therefore, it is preferable to change the number of drying nozzles depending on the property of ink or the property of a print target medium, that is, depending on the drying characteristics of an image formed on the print target medium. For example, to lengthen time for drying a background image, the number of drying nozzles is increased, which increases the number of times of drying-pass execution. In other words, it is preferable to change the ratio of the length of a nozzle area where drying nozzles are located in the transportation direction (6*d* in FIG. 8) to the unit transportation amount of a print target medium (3*d*) depending on the property of ink or the property of a print target medium.

As explained above, it is possible to lengthen time for drying a background image by increasing the number of drying nozzles, thereby avoiding deterioration in image quality due to the running of ink reliably. However, since the number of nozzles that belong to a nozzle line is predetermined (one hundred and eighty in FIG. 3), as the number of drying nozzles increases, the number of active ejection nozzles for forming an image decreases. Therefore, too many drying nozzles make printing time long, which is not desirable. To put it the other way around, the number of nozzles that belong to a nozzle line has to be increased to ensure that the number of active ejection nozzles for forming an image is sufficient.

Figure 9:
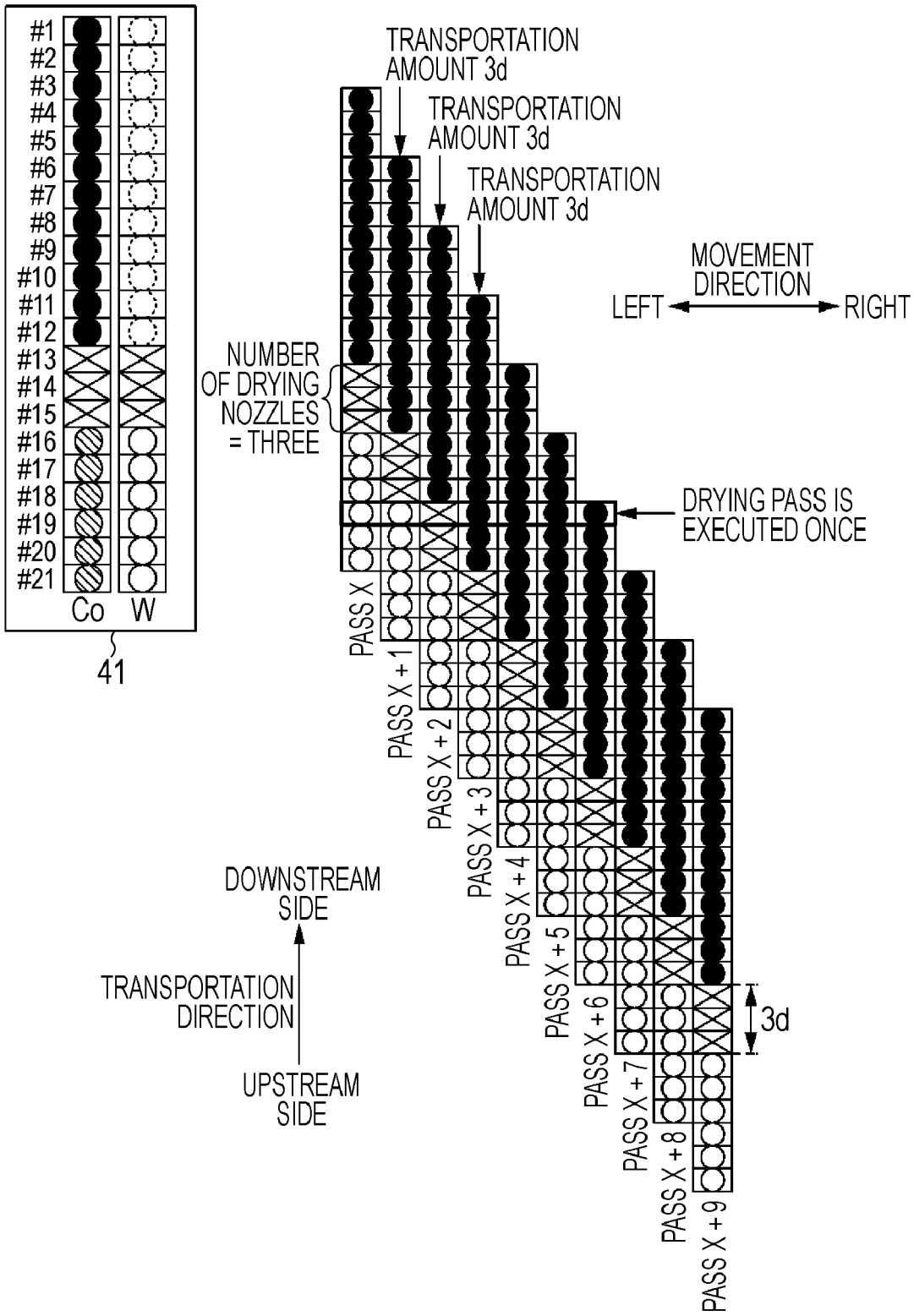
FIG. 9 is a diagram that schematically illustrates an example of a printing method in which drying nozzles are located at a nozzle area other than the center area in a nozzle line.

FIG. 9 is a diagram that schematically illustrates an example of a printing method in which drying nozzles are located at a nozzle area other than the center area in a nozzle line. In the foregoing description (FIGS. 6 and 8), the number of active ejection nozzles for printing a background image is the same as that for a color image. Accordingly, the number of passes for printing the background image is the same as that for the color image. For this reason, drying nozzles that are set between the active ejection nozzles for the background image and the active ejection nozzles for the color image are located at the center area in a nozzle line. For example, in FIG. 6, the drying nozzles are set as the #10, #11, and #12 nozzles at the center area in a nozzle line made up of twenty-one nozzles. However, the location of drying nozzles is not limited to the center area in a nozzle line. The number of passes for printing a background image may be different from that for a color image. Accordingly, the number of active ejection nozzles for printing the background image may be different from that for the color image.

For example, in FIG. 9, six nozzles belonging to each of the white nozzle line W and the color nozzle line Co at the upstream side in the transportation direction (#16 to #21) are set as active ejection nozzles for a background image. Twelve nozzles belonging to the color nozzle line Co at the downstream side in the transportation direction (#1 to #12) are set as active ejection nozzles for a color image. Three drying nozzles (#13, #14, and #15) are set therebetween. With the above nozzle configuration, the background image is printed in two passes, whereas the color image is printed in four passes. Drying pass is executed once between the background passes and the color passes. In this example, the drying nozzles are located upstream of the center area in a nozzle line in the transportation direction. The length of the nozzle area where the drying nozzles are located in the transportation direction (3*d*) is an integral multiple of (equal to, ×1) the unit transportation amount of a print target medium (3*d*). Therefore, even though the number of the active ejection nozzles for printing the background image is different from that for the color image, the length of time for drying the background image is constant. Thus, it is possible to suppress non-uniformity in the depth of shade of an image obtained.

Method for Printing Three Images in Layers

Figure 10:
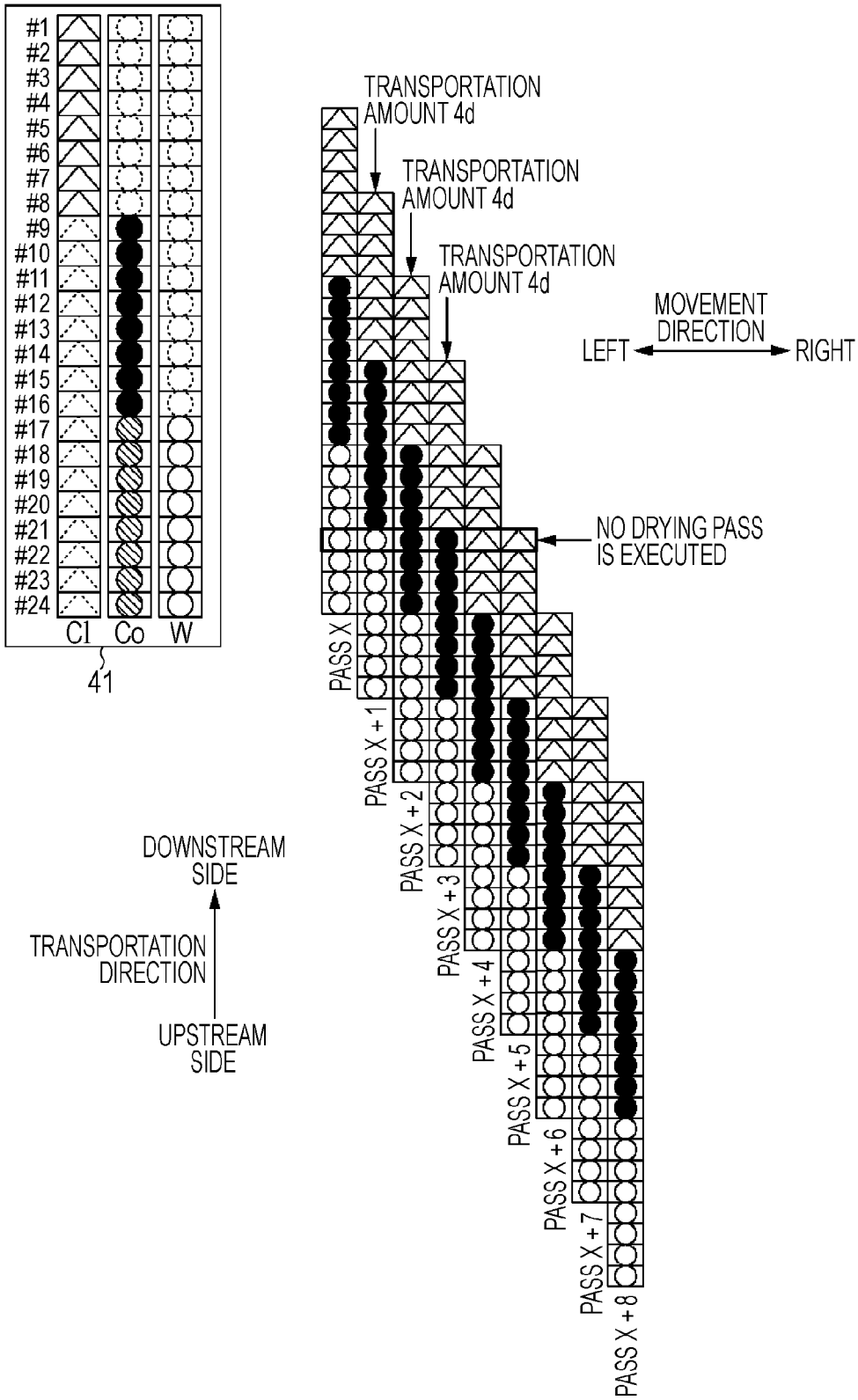
FIG. 10 is a diagram that schematically illustrates an example of a method for printing three images in layers without drying pass.

FIG. 10 is a diagram that schematically illustrates an example of a method for printing three images in layers without drying pass. The following printed matter is taken as an example. The printed matter includes three images printed in layers in different (sets of) passes. A background image having the color of adjusted white is printed with the use of white ink and color ink. A color image is printed on the background image. Thereafter, clear ink is ejected onto the entire image surface. Though the head 41 illustrated in FIG. 3 has the four-color ink nozzle line YMCK (i.e., the color nozzle line Co) and the white nozzle line W only, a head 41C corresponding to FIG. 10 has a clear ink nozzle line Cl in addition to these nozzle lines.

In FIG. 10, the number of nozzles that belong to a nozzle line is twenty-four. The number of active ejection nozzles for forming each of the three images is eight, wherein the number of the active ejection nozzles for forming the background image is eight in each of the white nozzle line W and the color nozzle line Co. For printing each of the three images in two passes, the transportation amount of a print target medium in each execution of transportation operation is four times as large as the nozzle pitch d (4*d*). Eight nozzles belonging to each of the white nozzle line W and the color nozzle line Co at the upstream side in the transportation direction (#17 to #24) are set as the active ejection nozzles for the background image, which is printed first. Eight nozzles belonging to the color nozzle line Co at the center area (#9 to #16) are set as the active ejection nozzles for the color image, which is printed next. Eight nozzles belonging to the clear ink nozzle line Cl at the downstream side in the transportation direction (#1 to #8) are set as the active ejection nozzles for the clear ink image, which is printed last.

With the above nozzle configuration, the background image is printed in the first set of two passes. The color image is printed in the next set of two passes. The clear ink image is printed in the last set of two passes. In FIG. 10, no drying nozzle is set between the active ejection nozzles for the background image and the active ejection nozzles for the color image or between the active ejection nozzles for the color image and the active ejection nozzles for the clear ink image. Therefore, no drying pass is executed therebetween. If ink ejected before the printing of an upper-layer image has excellent drying property or if a print target medium has excellent ink-absorbing property, it is not necessary to set long background/color drying time. The printing method illustrated in FIG. 10 is efficient in such a case.

Figure 11:
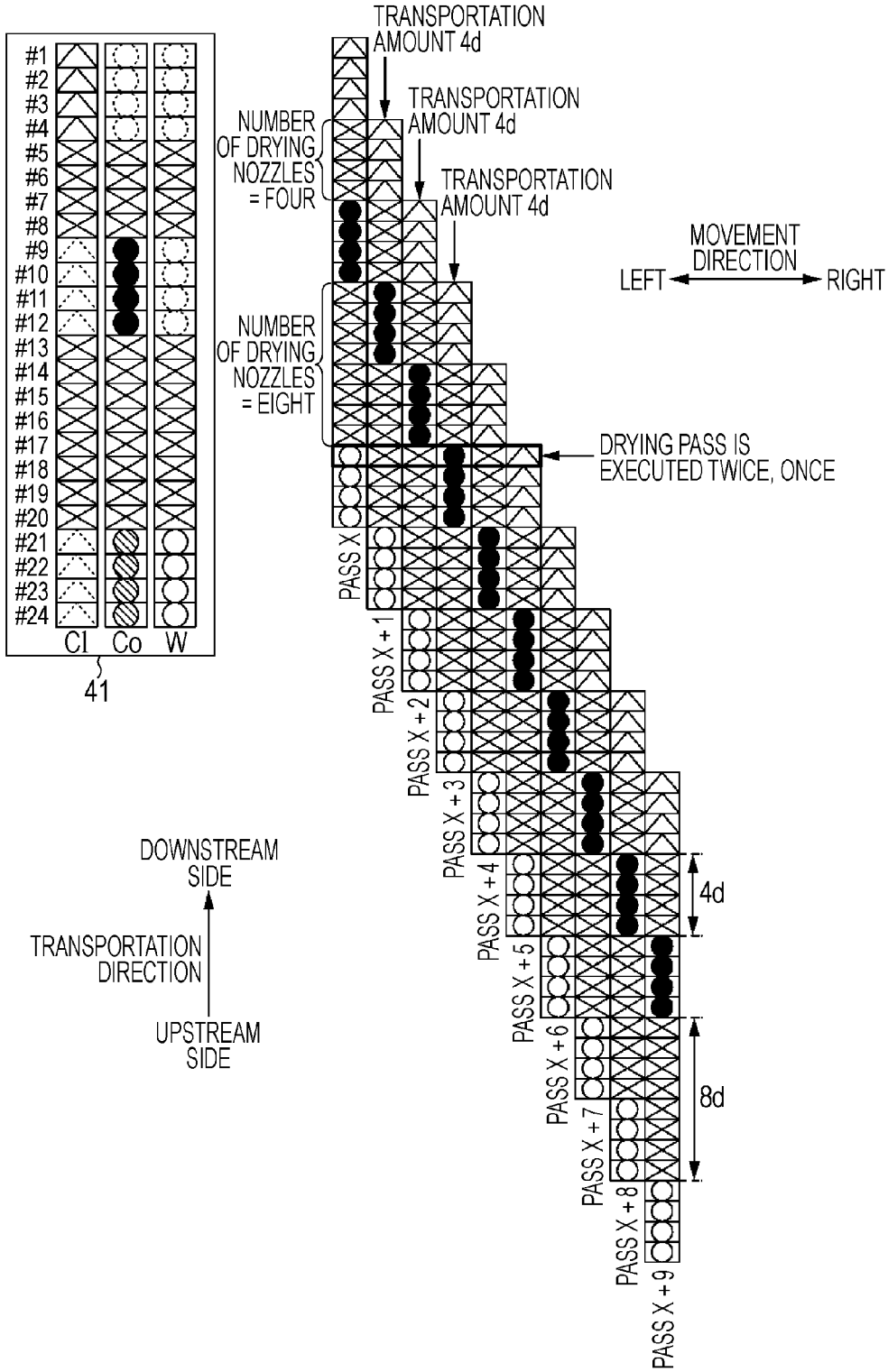
FIG. 11 is a diagram that schematically illustrates an example of a method for printing three images in layers with drying pass (passes).

FIG. 11 is a diagram that schematically illustrates an example of a method for printing three images in layers with drying pass (passes). In FIG. 11, the number of nozzles that belong to a nozzle line is twenty-four. Four nozzles belonging to each of the white nozzle line W and the color nozzle line Co at the upstream side (i.e., the upstream end area) in the transportation direction (#21 to #24) are set as active ejection nozzles for a background image. Four nozzles belonging to the color nozzle line Co at a relatively downstream area (#9 to #12) are set as active ejection nozzles for a color image. Four nozzles belonging to the clear ink nozzle line Cl at the downstream end area in the transportation direction (#1 to #4) are set as active ejection nozzles for a clear ink image. Each of the three images is printed in one pass. The transportation amount of a print target medium in each execution of transportation operation is four times as large as the nozzle pitch d (4*d*).

In this example, it is assumed that the background image is harder to dry than the color image. Therefore, it is desired to set the length of background drying time longer than the length of color drying time. In other words, it is desired to set the number of times of drying-pass execution during time from the end of the printing of the background image to the start of the printing of the color image larger than that during time from the end of the printing of the color image to the start of the printing of the clear ink image at a certain area of a print target medium.

In order to set the length of background drying time longer than the length of color drying time, the nozzles are configured as follows. The number of drying nozzles set between the active ejection nozzles for the background image (denoted as white circles and shaded circles) and the active ejection nozzles for the color image (denoted as black circles), which is eight (=eight quadrangular cells), is twice as large as the number of nozzles corresponding to the unit transportation amount 4*d*, which is four (=four quadrangular cells). The number of drying nozzles set between the active ejection nozzles for the color image (denoted as black circles) and the active ejection nozzles for the clear ink image (denoted as triangles), which is four (=four quadrangular cells), is equal to the number of nozzles corresponding to the unit transportation amount 4*d*, which is four. That is, the number of the drying nozzles set between the active ejection nozzles for the background image and the active ejection nozzles for the color image is larger than the number of the drying nozzles set between the active ejection nozzles for the color image and the active ejection nozzles for the clear ink image.

With the above nozzle configuration, a certain area of a print target medium faces drying nozzles in two passes after the printing of a background image. Thereafter, the area faces drying nozzles in one pass after the printing of a color image. In this way, it is possible to set the number of times of drying-pass execution after the printing of the background image (i.e., twice) larger than that after the printing of the color image (i.e., once). This will be understood by referring to the nozzles arranged in the movement direction inside the thick lines in the right part of FIG. 11. That is, the enclosed nozzle array is made up of one active ejection nozzle for a background image (denoted as a white circle) (W and Co), two drying nozzles (denoted as crosses), one active ejection nozzle for a color image (denoted as a black circle) (Co), another drying nozzle (denoted as another cross), and one active ejection nozzle for a clear ink image (denoted as a triangle) (Cl).

If the length of drying time (the number of times of drying-pass execution) is not constant after the printing of an image (which is a background image in FIG. 5) as in a printing method according to the comparative example of FIG. 5, the depth of shade of an image obtained will not be uniform. However, when three (or more) images are printed in layers, even if the length of drying time after the printing of a certain kind of image (e.g., a background image) is made different from the length of drying time after the printing of another kind of image (e.g., a color image) depending on the drying characteristics of the images, non-uniformity in the depth of shade of an image obtained will not occur. Moreover, such different lengths of drying time depending on the drying characteristics of images make it possible to shorten printing time because it is not necessary to set wastefully long drying time for an image(s) having excellent/good drying characteristics so that the time should be long enough for an image(s) having poor drying characteristics. Furthermore, too short drying time will not be set on the basis of the image(s) having better drying characteristics. Therefore, it is possible to avoid deterioration in image quality due to the running of ink reliably.

Method for Printing Four Images in Layers

Figure 12:
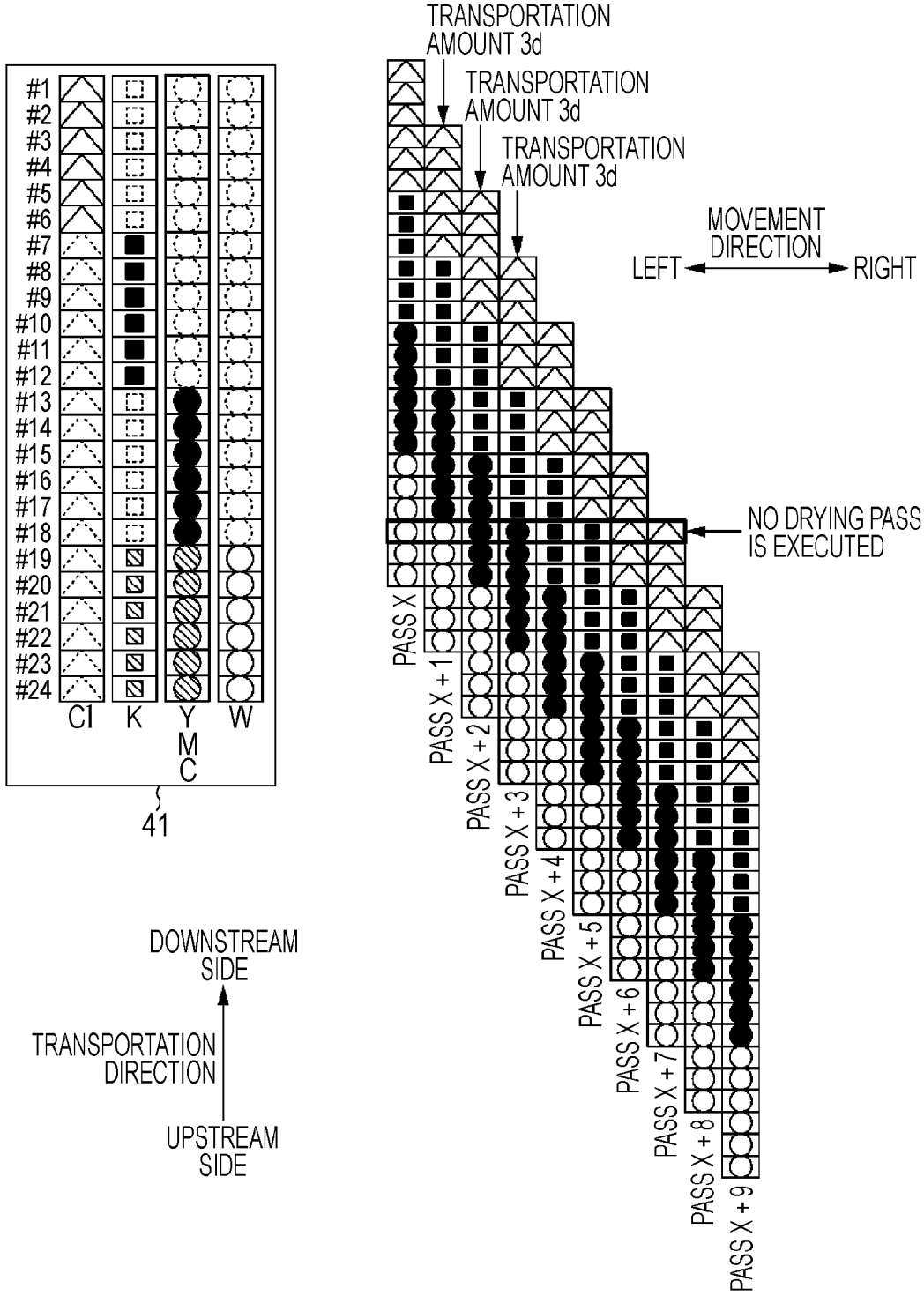
FIG. 12 is a diagram that schematically illustrates an example of a method for printing four images in layers without drying pass.

FIG. 12 is a diagram that schematically illustrates an example of a method for printing four images in layers without drying pass. The following printed matter is taken as an example. The printed matter includes four images printed in layers in different (sets of) passes. A background image having the color of adjusted white is printed first by using white ink and four-color ink (YMCK). A three-color image is printed on the background image by using three-color ink (YMC). Then, a text image is printed thereon by using black ink (K). Thereafter, clear ink is ejected onto the entire image surface.

In FIG. 12, the number of nozzles that belong to a nozzle line is twenty-four. The number of active ejection nozzles for forming each of the four images is six, wherein the number of the active ejection nozzles for forming the background image is six in each of the white nozzle line W, the three-color nozzle line YMC, and the black nozzle line K. For printing each of the four images in two passes, the transportation amount of a print target medium in each execution of transportation operation is three times as large as the nozzle pitch d (3*d*). Six nozzles belonging to each of the white nozzle line W, the three-color nozzle line YMC, and the black nozzle line K at the upstream side in the transportation direction (#19 to #24) are set as the active ejection nozzles for the background image, which is printed as the first image. Six nozzles belonging to the three-color nozzle line YMC (#13 to #18) are set as the active ejection nozzles for the three-color image, which is printed as the second image. Six nozzles belonging to the black nozzle line K (#7 to #12) are set as the active ejection nozzles for the text image, which is printed as the third image. Six nozzles belonging to the clear ink nozzle line Cl (#1 to #6) are set as the active ejection nozzles for the clear ink image, which is printed as the last image. With the above nozzle configuration, the background image is printed in the first set of two passes at a certain area of a print target medium. The three-color image is printed in the second set of two passes thereat. The text image is printed in the third set of two passes thereat. The clear ink image is printed in the last set of two passes thereat.

Figure 13:
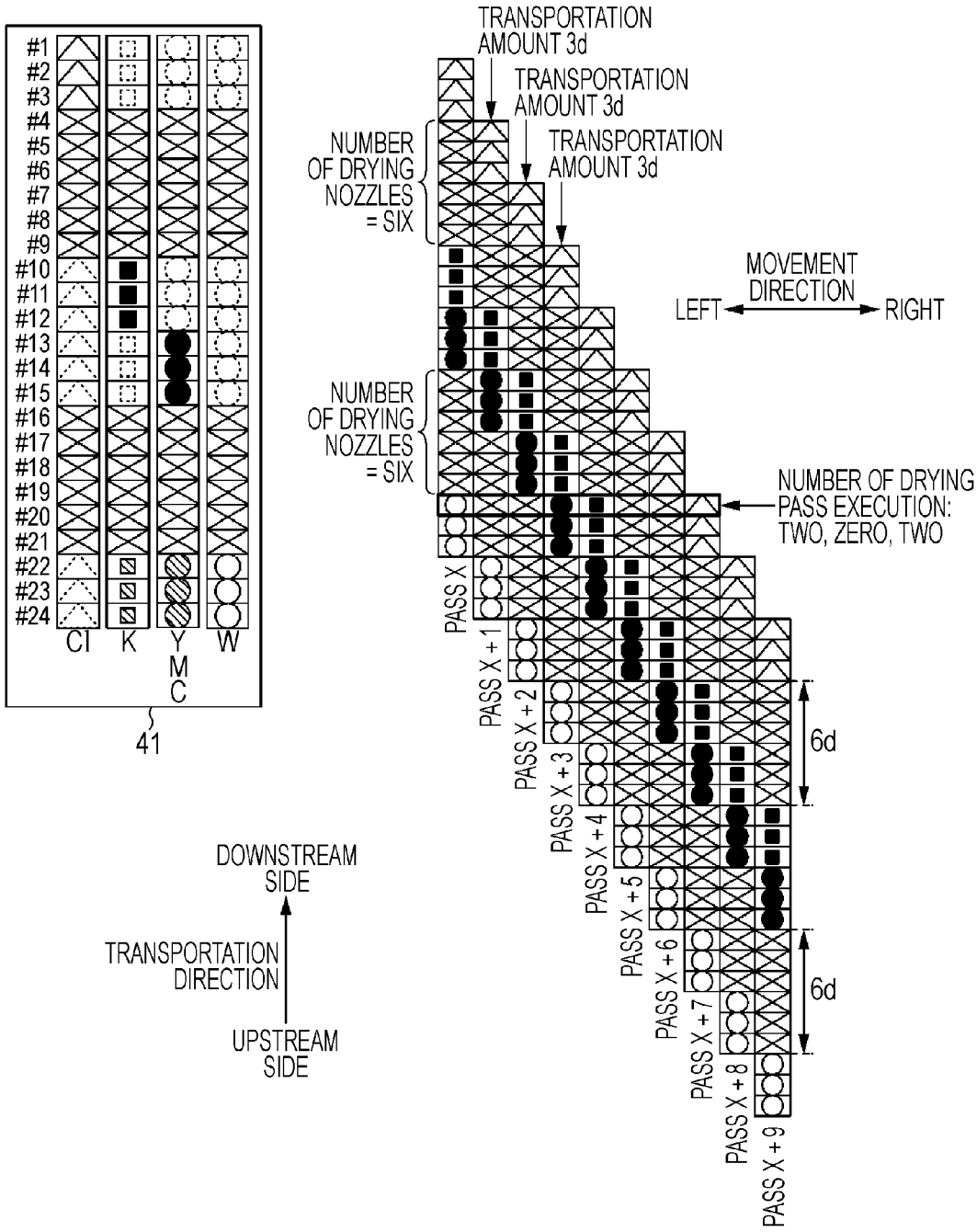
FIG. 13 is a diagram that schematically illustrates an example of a method for printing four images in layers with drying passes.

FIG. 13 is a diagram that schematically illustrates an example of a method for printing four images in layers with drying passes. In FIG. 13, the number of nozzles that belong to a nozzle line is twenty-four. The transportation amount of a print target medium in each execution of transportation operation is 3*d*. Three nozzles belonging to each of the white nozzle line W, the three-color nozzle line YMC, and the black nozzle line K (#22, #23, and #24), three nozzles belonging to the three-color nozzle line YMC (#13, #14, and #15), three nozzles belonging to the black nozzle line K (#10, #11, and #12), and three nozzles belonging to the clear ink nozzle line Cl (#1, #2, and #3) are set as active ejection nozzles.

It is assumed that each of the background image and the text image has poor drying characteristics, whereas the color image has excellent drying characteristics. In view of the above drying characteristics, six drying nozzles (for each nozzle line) are set between the active ejection nozzles for the background image in the white nozzle line W and the color nozzle line Co (YMCK) and the active ejection nozzles for the three-color image in the three-color nozzle line (YMC). In addition, six drying nozzles are set between the active ejection nozzles for the text image in the black nozzle line K and the active ejection nozzles for the clear ink image in the clear ink nozzle line (C1).

No drying nozzle is set between the active ejection nozzles for the three-color image and the active ejection nozzles for the text image. That is, the interval between the downstream-end one of the active ejection nozzles for the three-color image (denoted as a black circle) and the upstream-end one of the active ejection nozzles for the text image (denoted as a black square) is set as the nozzle pitch d. Therefore, drying pass is executed twice after the printing of each of the background image and the text image at a certain area of a print target medium. The text image is printed immediately after the printing of the three-color image without any drying pass. Likewise the foregoing embodiments, in FIG. 13, the length of a nozzle area where drying nozzles are located in the transportation direction (6*d*) is an integral multiple of (twice as large as) the unit transportation amount of a print target medium (3*d*). Therefore, the number of times of drying-pass execution is constant. Thus, it is possible to suppress non-uniformity in the depth of shade of an image obtained.

As explained above, when three or more images are printed in layers, drying pass may be executed after the printing of some kinds (or a certain kind) of image (e.g., a background image and a text image), whereas drying pass may be omitted after the printing of another kind (or the other kinds) of image (e.g., a color image). By this means, it is possible to avoid deterioration in image quality due to the running of ink reliably and shorten printing time as much as possible.

Background Image Having Color of Adjusted White

In the foregoing description, it is explained that drying nozzles are set between active ejection nozzles for a background image having the color of adjusted white and active ejection nozzles for a color image when the color image is printed with the use of color ink on the background image printed with the use of white ink and the color ink (CMYK). Next, processing for setting adjusted white to output desired white by mixing color ink with white ink is explained below. In addition, processing for creating print data is explained. The print data is used for printing a background image having the color of adjusted white. A printer driver installed in the computer 60, which is connected to the printer 1 as an external device, performs the processing explained below.

Processing for Setting Adjusted White

Figure 14:
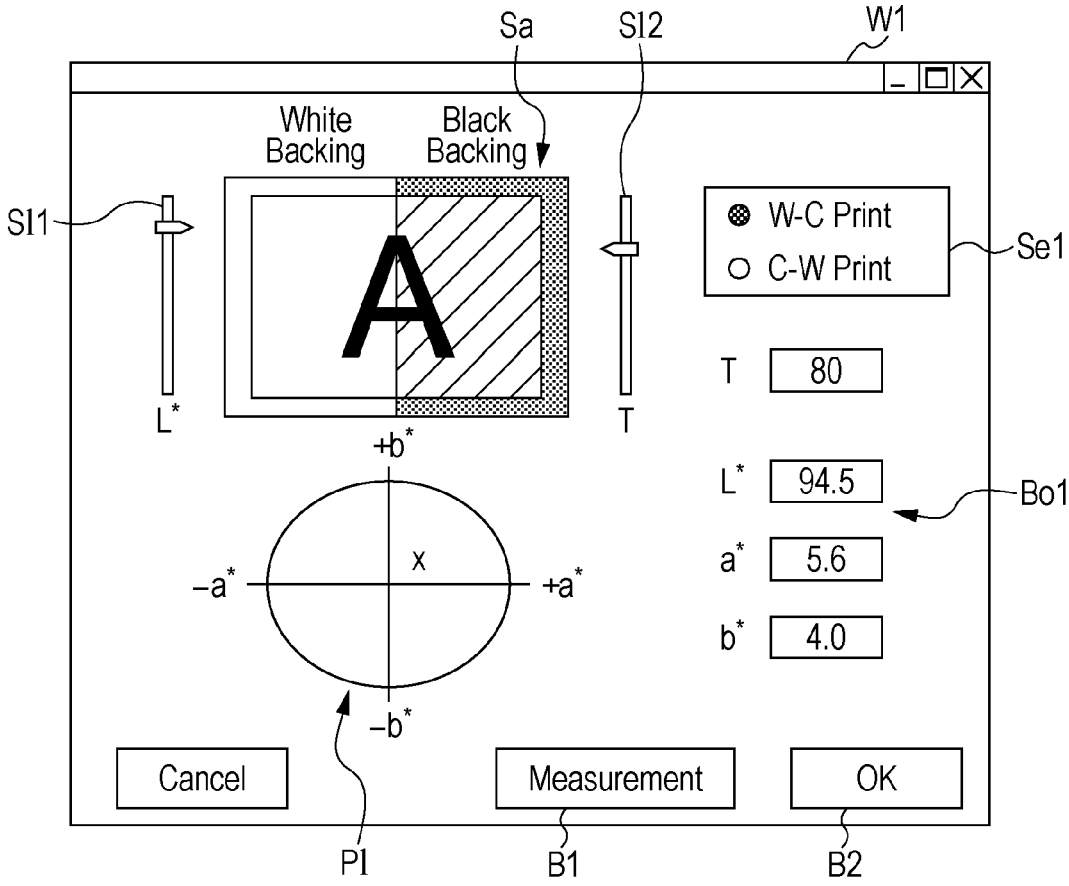
FIG. 14 is a diagram that schematically illustrates an example of a window for setting adjusted white according to an exemplary embodiment of the invention.

FIG. 14 is a diagram that schematically illustrates an example of a window for setting adjusted white according to an exemplary embodiment of the invention. Upon receiving image data that contains an image (background image) having the color of adjusted white from any of various application programs, the printer driver causes a display device to display a window for setting adjusted white (hereinafter referred to as "adjusted white setting window") W1 illustrated in FIG. 14 as an interface to a user. The adjusted white setting window W1 contains a sample image display area Sa, two slider bars Sl1 and Sl2, an a-b plane display area Pl, an order-of-printing setting box Se1, value input boxes Bo1, a measurement button B1, and an OK button B2.

In the adjusted white setting window W1 illustrated in FIG. 14, the sample image display area Sa is an area for displaying a sample image having the color of adjusted white in accordance with setting. The sample image display area Sa is split in two area parts. The left part is an area for showing adjusted white in white "backing" (hereinafter referred to as "white background area"). The right part is an area for showing adjusted white in black backing (hereinafter referred to as "black background area"). The peripheral region of the sample image display area Sa is an area for showing a background color (white or black) (hereinafter referred to as "background color area"). The area inside the background color area is a "white image area" for showing adjusted white. The color that will be outputted when an adjusted-white background image is printed is shown in the white image area. A color image, which is an image of a letter A in the illustrated example, is displayed approximately at the center region of the sample image display area Sa.

In the adjusted white setting window W1, the value input boxes Bo1 are fields for setting "adjusted white" by inputting color coordinate values L*, a*, and b* in a L*a*b* color coordinate system and a T value therein. The color coordinate values L*, a*, and b* may be hereinafter denoted simply as L (L value), a ("a" value), and b ("b" value), respectively. The L value is a value that indicates the luminosity of adjusted white. The L value correlates with the amount of black ink (K) used when an image having the color of adjusted white is printed. The "a" and "b" values are values that indicate the chromaticity of adjusted white along a red-green axis and a yellow-blue axis, respectively. Each of these two values correlates with the amount of color ink (YMC) used when an image having the color of adjusted white is printed. The T value is a value that indicates the depth of shade (density). The T value correlates with the amount of ink used per unit area when an image having the color of adjusted white is printed. That is, the T value correlates with background color transmittance. A user can set adjusted white corresponding to the Lab values and the T value by operating the slider bars Sl1 and Sl2 and making adjustment in the a-b plane display area Pl instead of setting these values numerically.

The order-of-printing setting box Se1 in the adjusted white setting window W1 is a box for setting a print order as demanded by the application program. To simplify explanation, a box for setting the sequential order of printing two images in layers is taken as an example. In the foregoing description, it is explained that a background image having the color of adjusted white is printed first by using white ink and color ink (YMCK), followed by the printing of a color image on the background image by using the color ink. The foregoing printing scheme is called as surface printing. Surface printing is shown as "W-C print" in FIG. 14. However, the scope of the invention is not limited to so-called surface printing. For example, a color image may be printed first on a print target medium such as a transparent film. Thereafter, a background image is printed on the color image. Such a printing scheme is called as back printing, which is shown as "C-W print" in FIG. 14. An image printed by using the back printing scheme is observed not from the printed-face side but from the opposite-face side. That is, the order-of-printing setting box Se1 shows which of the two images in this example, that is, the image having the color of adjusted white or the color image, is printed first.

When a user inputs values in the value input boxes Bo1, the color displayed in the sample image display area Sa changes into a color (adjusted white) that is specified by the input values. For example, when the user changes the a or b value (or a and b values), the hue (i.e., "color") of the color displayed in the white image area of the sample image display area Sa changes. When the user changes the L value, the luminosity of the color displayed in the white image area of the sample image display area Sa changes. Since background color transmittance changes when the T value is changed, the luminosity of the color displayed in the white image area in the black background area of the sample image display area Sa changes, whereas the color displayed in the white image area in the white background area thereof does not change. Therefore, a user can easily recognize a change in color corresponding to the T value (density value) by comparing the black background area of the sample image display area Sa with the white background area thereof. Thus, the user can set adjusted white precisely and easily. When the color displayed in the white image area of the sample image display area Sa agrees with white that the user desires, they depress the OK button B2.

By this means, the printer driver can acquire values (the Lab values and the T value) related to the color of a user-desired adjusted white image. Incidentally, an image having the color of adjusted white may be actually printed on the basis of values (the Lab values and the T value) set by a user to carry out the color measurement of the printed image. On the basis of the result of measurement, the user can adjust values (the Lab values and the T value) related to the color of an adjusted white image more precisely and easily.

Processing for Creating Print Data

Next, the printer driver performs color conversion processing, ink color separation processing, and halftone processing for an adjusted white image. As a first step of print data creation processing, the printer driver performs the color conversion processing. In the color conversion processing, the Lab values set in the processing for setting adjusted white explained above are converted into YMCK values. To perform the color conversion processing, the printer driver looks up a table for an adjusted white image (hereinafter referred to as "adjusted white image lookup table") LUTw1, which is not illustrated in the drawing. Lab values and YMCK values are pre-stored in association with each other in the adjusted white image lookup table LUTw1. That is, the adjusted white image lookup table LUTw1 contains correspondence therebetween. In the adjusted white image lookup table LUTw1, the tone value of each of Y, M, C, and K is set as a value that is not smaller than zero and not larger than one hundred (i.e., as a comparatively subtle color).

Next, the printer driver performs the ink color separation processing. The ink color separation processing is processing for converting a combination of the YMCK values, which have been obtained from the Lab values of the adjusted white image as a result of the color conversion explained above, and the T value into a tone value for each of ink colors. The printer 1 according to the present embodiment of the invention can use ink of five colors, which is cyan C, magenta M, yellow Y, black K, and white W, for printing. Therefore, in the ink color separation processing, a combination of the YMCK values and the T value is converted into a tone value for each of these five ink colors (YMCKW).

To perform the ink color separation processing, the printer driver looks up another adjusted white image lookup table LUTw2, which is not illustrated in the drawing. The adjusted white image lookup table LUTw2 contains correspondence between a combination of the YMCK values and the T value and a tone value for each of the five ink colors (YMCKW). In the adjusted white image lookup table LUTw2, the tone value for each of the five ink colors (YMCKW) is set as a value that is not smaller than zero and not larger than two hundred and fifty-five (i.e., in a 256 tone-value range).

Next, the printer driver performs the halftone processing for converting continuous tone data (i.e., 256 "high tone" data) into dot ON/OFF data that the printer 1 can reproduce (hereinafter referred to as "dot data"). For example, the printer driver performs the halftone processing as follows. A tone value for each ink color for a pixel (high tone data) is taken out. The value taken out is converted into low tone data (i.e., dot data) with reference to a dither pattern for each ink color.

As done for an adjusted white image, the printer driver performs the ink color separation processing and the halftone processing for a color image (YMCK image). The printer driver looks up a color image lookup table, which is not illustrated in the drawing. While referring to the table, the printer driver converts color image data into a tone value of each color of ink that the printer 1 can use (YMCK). For example, if color image data that the printer driver has received from the application program is RGB data, the printer driver performs the ink color separation processing to convert the RGB data into YMCK data. Then, the printer driver performs the halftone processing for the YMCK data for a color image, thereby converting high tone data into dot data.

As a result of the above processing, the printer driver obtains dot data for printing an image (background image) having the color of adjusted white (YMCKW) and dot data for printing a color image (YMCK). The printer driver sends the dot data obtained as explained above to the printer 1 together with other command data (e.g., ink type, order of printing, and the like).

Processing of Printer 1

Figure 15:
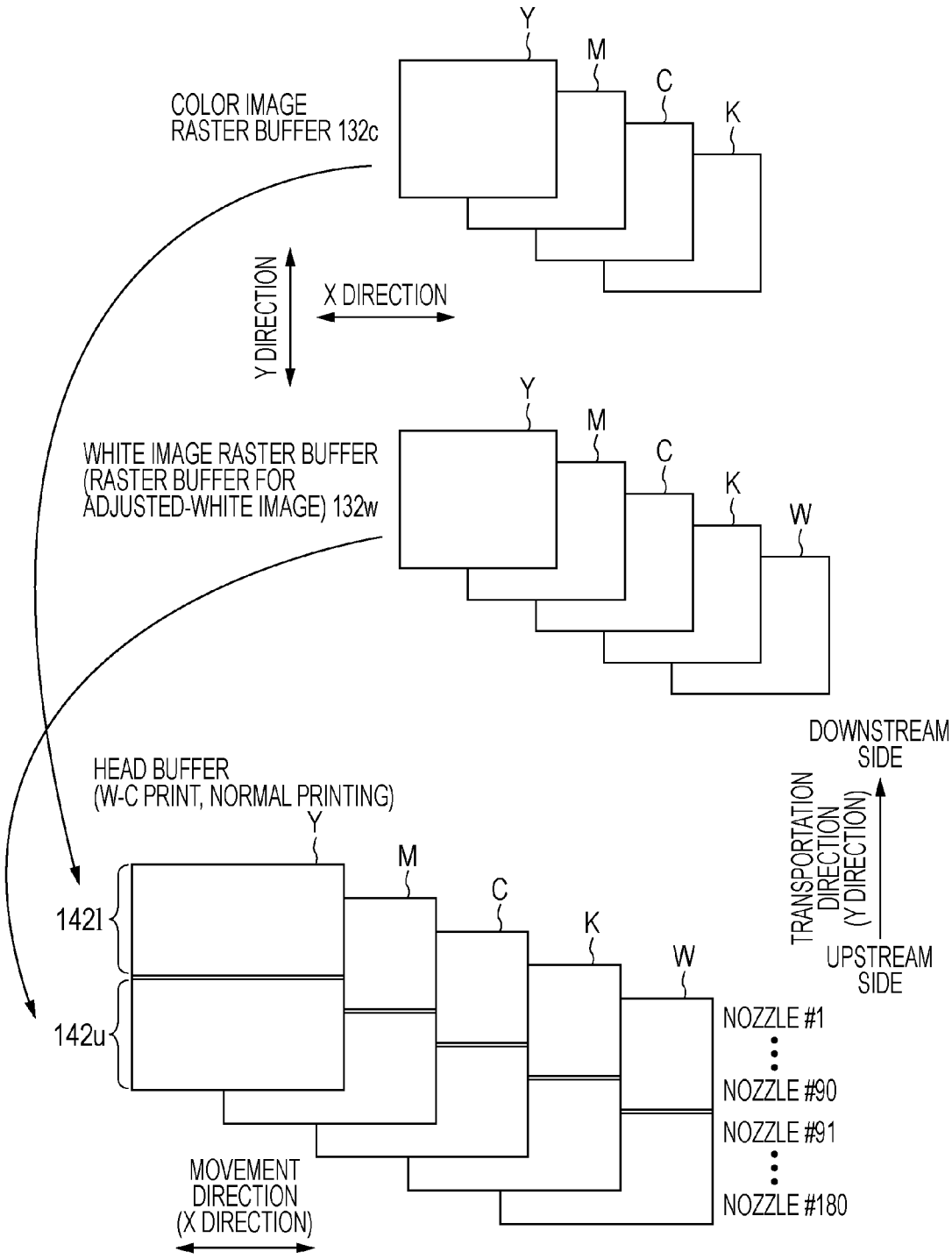
FIG. 15 is a diagram that schematically illustrates an example of a raster buffer and a head buffer according to an exemplary embodiment of the invention.

FIG. 15 is a diagram that schematically illustrates an example of a raster buffer and a head buffer according to an exemplary embodiment of the invention. The printer 1 according to the present embodiment of the invention has a raster buffer. The controller 10 stores a part of dot data that the printer 1 receives from the printer driver (e.g., data for one pass) into the raster buffer. The raster buffer includes two buffer spaces, which are a color image raster buffer 132*c* and a white image raster buffer 132*w*. The white image raster buffer 132*w* is a raster buffer for an adjusted white image. The color image raster buffer 132*c* is shown at the upper part of FIG. 15. The white image raster buffer 132*w* is shown at the middle part of FIG. 15. The head unit 40 has a head buffer. The head buffer includes an upstream head buffer 142*u* and a downstream head buffer 142*l*.

The controller 10 stores dot data related to a color image in the color image raster buffer 132*c*. The controller 10 stores dot data related to a white image (adjusted white image, background image) in the white image raster buffer 132*w*. As illustrated in FIG. 15, an area is assigned to each of the ink colors (YMCKW) in the raster buffer. Accordingly, the controller 10 stores a part of received dot data into an area corresponding to each of the ink colors in the raster buffer. The size of each area in the raster buffer in the X direction, which corresponds to the direction of the movement of the head 41, is equal to the width of an image, that is, the distance of the movement of the head 41. The size of each area in the raster buffer in the Y direction, which corresponds to the transportation direction, is not smaller than one half of the length of a nozzle line.

The head buffer is shown at the lower part of FIG. 15. As illustrated in FIG. 5, an area is assigned to each nozzle line (YMCKW) of the head 41. That is, the head buffer is configured as a set of a yellow area, a magenta area, a cyan area, a black area, and a white area. The size of each area in the head buffer in the X direction (i.e., movement direction) is equal to the distance of the movement of the head 41. The size of each area in the head buffer in the Y direction (i.e., transportation direction) corresponds to the number of nozzles that make up a nozzle line.

Each area in the head buffer is subdivided into an upstream sub area (142*u*) and a downstream sub area (142*l*). As illustrated in FIG. 3, each nozzle line formed in the head 41 of the printer 1 according to the present embodiment of the invention is made up of one hundred and eighty nozzles. In this example, one half of the one hundred and eighty nozzles that are located at the downstream side in the transportation direction (#1 to #90) are collectively referred to as "downstream group of nozzles". The other half of these nozzles, which are located at the upstream side in the transportation direction (#91 to #180), are collectively referred to as "upstream group of nozzles". The upstream head buffer 142*u* shown in FIG. 15 is a head buffer that corresponds to the upstream group of nozzles (#91 to #180). The downstream head buffer 142*l* shown in FIG. 15 is a head buffer that corresponds to the downstream group of nozzles (#1 to #90).

To perform printing for a certain area part of image data (e.g., an area corresponding to one pass), as a first step, the controller 10 stores dot data corresponding to the area into the raster buffer for each ink color. Thereafter, the controller 10 transfers the data stored in the raster buffer to the head buffer in synchronization with print timing. Then, the controller 10 controls the head 41 to discharge ink droplets from each of the nozzle lines (YMCKW) for printing an image on the basis of the dot data, which is stored in the head buffer. After transferring the stored dot data to the head buffer, the controller 10 stores new dot data into the raster buffer until printing is completed while using all dot data.

In the present embodiment of the invention, after the printing of a background image having the color of adjusted white by using a mixture of white ink (W) and color ink (YMCK), a color image is printed on the background image by using the color ink (YMCK). For example, as illustrated in FIG. 6, nozzles belonging to each of the white nozzle line W and the color nozzle line Co at the upstream side in the transportation direction are used to print a background image having the color of adjusted white. Nozzles belonging to the color nozzle line Co at the downstream side in the transportation direction are used to print a color image. Therefore, (in normal printing) the controller 10 transfers the dot data stored in the color image raster buffer 132*c* to the downstream head buffer 142*l* and transfers the dot data stored in the white image raster buffer 132*w* to the upstream head buffer 142*u* as illustrated in FIG. 15. By this means, it is possible to print a color image by using the nozzles belonging to the color nozzle line Co at the downstream side in the transportation direction and print a background image by using the nozzles belonging to each of the white nozzle line W and the color nozzle line Co at the upstream side in the transportation direction.

In some cases, a color image is printed first on a print target medium such as a transparent film; thereafter, a background image having the color of adjusted white is printed on the color image. In such a printing scheme, in normal printing, nozzles belonging to the color nozzle line Co at the upstream side in the transportation direction are used to print a color image first. Then, nozzles belonging to each of the white nozzle line W and the color nozzle line Co at the downstream side in the transportation direction are used to print a background image on the color image. Therefore, the controller 10 transfers the dot data stored in the color image raster buffer 132*c* to the upstream head buffer 142*u* and transfers the dot data stored in the white image raster buffer 132*w* to the downstream head buffer 142*l*.

Other Embodiments

The foregoing exemplary embodiments of the invention are primarily directed to a printing system that includes an ink-jet printer. However, they also include the disclosure of a method for suppressing (e.g., correcting) non-uniformity in the depth of shade without any limitation thereto. Although the technical concept of the present invention is explained above with the disclosure of exemplary embodiments, the specific embodiments are provided solely for the purpose of facilitating the understanding of the invention. The above explanatory embodiments should not be interpreted to limit the scope of the invention. The invention may be modified, altered, changed, adapted, and/or improved within a range not departing from the gist and/or spirit of the invention apprehended by a person skilled in the art from explicit and implicit description made herein, where such a modification, an alteration, a change, an adaptation, and/or an improvement is also encompassed within the scope of the appended claims. It is the intention of the inventor/applicant that the scope of the invention covers any equivalents thereof. As specific examples, the following variations are encompassed within the scope of the invention.

Printed Matter

In the foregoing embodiments of the invention, a printed matter that includes a background image having the color of adjusted white that is printed by using white ink and color ink is taken as an example. However, the scope of the invention is not limited to such an example. For example, a background image may be printed with the use of ink other than white ink (e.g., color ink or metallic ink); then, the hue (i.e., color) of the background image may be adjusted by means of ink that is used for printing an image on the background image. As another modification example, for the purpose of improving the color reproduction property of an image, both color ink (YMCK) and white ink may be used to print a color image on a background image having the color of adjusted white.

As still another modification example, after the printing of a background image by using white ink only, a color image may be printed on the background image by using the white ink and color ink (YMCK). To produce such a modified printed matter, for example, in normal printing, nozzles belonging to the white nozzle line W at the upstream side in the transportation direction (e.g., nozzles #13 to #21 in FIG. 6) are used to print a background image first. Then, nozzles belonging to each of the white nozzle line W and the color nozzle line Co at the downstream side in the transportation direction (e.g., nozzles #1 to #9 in FIG. 6) are used to print a color image on the background image. As explained in the foregoing embodiments, it is preferable to set the length of a nozzle area where drying nozzles are located in the transportation direction between active ejection nozzles for a background image and active ejection nozzles for a color image as an integral multiple of the unit transportation amount of a print target medium.

Printing Method

In the foregoing embodiments of the invention, an overlap printing scheme is taken as an example. However, the scope of the invention is not limited to such an example. As an example of other printing schemes, a plurality of raster lines may be formed in different passes between raster lines that are arranged at intervals of nozzle pitch as in interlace printing. In a printing scheme such as band printing in which a print target medium is transported by transportation amount that is equal to the width of an image formed in one pass, for example, nozzles that belong to each of the white nozzle line W and the color nozzle line Co at the upstream side and occupy one third of the nozzle line are set as active ejection nozzles; in addition, nozzles that belong to the color nozzle line Co at the downstream side and occupy one third of the nozzle line are set as active ejection nozzles. In such a printing scheme, since the transportation amount of a print target medium in each execution of transportation operation is equal to one third of the entire length of the nozzle line, the remaining one third of nozzles at the center area of the nozzle line are set as drying nozzles.

Fluid Ejecting Apparatus

In the foregoing embodiments of the invention, an ink-jet printer is explained as an example of a fluid ejecting apparatus. However, the scope of the invention is not limited to such an example. The invention can be applied not only to a printer but also to various industrial apparatuses that eject fluid. Examples of a fluid ejecting apparatus according to aspects of the invention include but not limited to: a textile printing apparatus for patterning textile, a color filter manufacturing apparatus, a display manufacturing apparatus used for manufacturing display devices such as organic electroluminescence (EL) displays, and a DNA chip manufacturing apparatus used for manufacturing DNA chips by applying solution in which DNA is dissolved to chips. A piezoelectric ejection scheme can be used for ejecting fluid. In the piezoelectric ejection scheme, a voltage is applied to driving elements (i.e., piezoelectric elements) to expand and contract ink chambers. The fluid is ejected due to pressure in the ink chambers. Alternatively, a thermal ejection scheme may be used for ejecting fluid. In the thermal ejection scheme, heater elements are used to form air bubbles in nozzles. The fluid is ejected due to the air bubbles. Ultraviolet ray curing ink, which hardens when exposed to ultraviolet rays, may be used as ink ejected from the head 41. When ultraviolet ray curing ink is used, it is preferable to mount a head that ejects the ultraviolet ray curing ink and an irradiator that irradiates the ultraviolet ray curing ink with ultraviolet rays on the carriage 31. The head 41 may eject powder.

What is claimed is:

1. A fluid ejecting apparatus comprising:

a first nozzle line that includes a plurality of first nozzles that are aligned in a predetermined direction, first fluid being ejected from the first nozzles;

a second nozzle line that includes a plurality of second nozzles that are aligned in the predetermined direction, second fluid being ejected from the second nozzles;

a movement mechanism that moves the first nozzle line and the second nozzle line relative to a target medium in a movement direction, the movement direction being orthogonal to the predetermined direction;

a transportation mechanism that transports the target medium relative to the first nozzle line and the second nozzle line in the predetermined direction;

a controlling section that performs control for repeating image formation operation and transportation operation, the image formation operation being operation for ejecting the first fluid from the first nozzles and ejecting the second fluid from the second nozzles while moving the first nozzle line and the second nozzle line in the movement direction by means of the movement mechanism, the transportation operation being operation for transporting the target medium relative to the first nozzle line and the second nozzle line in the predetermined direction by predetermined transportation amount by means of the transportation mechanism; and a group of nozzles that are not the first nozzles nor the second nozzles, wherein the image formation operation includes a certain image formation operation and another image formation operation, the controlling section performs control for forming a first image by using the first fluid and the second fluid in the certain image formation operation, the controlling section performs control for forming a second image on the first image by using at least the second fluid in the another image formation operation after lapse of time for drying the first image, the first nozzles and the second nozzles that are used for forming the first image are located upstream of the second nozzles that are used for forming the second image in the predetermined direction, the group of nozzles that are not the first nozzles nor the second nozzles are located downstream of the first nozzles and the second nozzles that are used for forming the first image in the predetermined direction, the group of nozzles that are not the first nozzles nor the second nozzles are located upstream of the second nozzles that are used for forming the second image in the predetermined direction, length of an area where the group of nozzles that are not the first nozzles nor the second nozzles are located in the predetermined direction is an integral multiple of the predetermined transportation amount, and the group of nozzles that are not the first nozzles nor the second nozzles do not eject any fluid.

2. The fluid ejecting apparatus according to claim 1, wherein the length of the area in the predetermined direction varies depending on drying characteristics of the first image formed on the target medium.

3. The fluid ejecting apparatus according to claim 1, wherein each of length of an area where the first nozzles and the second nozzles that are used for forming the first image are located in the predetermined direction and length of an area where the second nozzles that are used for forming the second image are located in the predetermined direction is an integral multiple of the predetermined transportation amount.

4. The fluid ejecting apparatus according to claim 1, wherein the second image is formed by using the first fluid and the second fluid, the first nozzles and the second nozzles that are used for forming the first image are located upstream of the first nozzles and the second nozzles that are used for forming the second image in the predetermined direction, the group of nozzles that are not the first nozzles nor the second nozzles are located downstream of the first nozzles and the second nozzles that are used for forming the first image in the predetermined direction, the group of nozzles that are not the first nozzles nor the second nozzles are located upstream of the first nozzles and the second nozzles that are used for forming the second image in the predetermined direction, the length of the area where the group of nozzles that are not the first nozzles nor the second nozzles are located in the predetermined direction is an integral multiple of the predetermined transportation amount, and the group of nozzles that are not the first nozzles nor the second nozzles do not eject any fluid.

5. A fluid ejecting apparatus comprising:

a first nozzle line that includes a plurality of first nozzles that are aligned in a predetermined direction, first fluid being ejected from the first nozzles;

a second nozzle line that includes a plurality of second nozzles that are aligned in the predetermined direction, second fluid being ejected from the second nozzles;

a movement mechanism that moves the first nozzle line and the second nozzle line relative to a target medium in a movement direction, the movement direction being orthogonal to the predetermined direction;

a transportation mechanism that transports the target medium relative to the first nozzle line and the second nozzle line in the predetermined direction;

a controlling section that performs control for repeating image formation operation and transportation operation, the image formation operation being operation for ejecting the first fluid from the first nozzles and ejecting the second fluid from the second nozzles while moving the first nozzle line and the second nozzle line in the movement direction by means of the movement mechanism, the transportation operation being operation for transporting the target medium relative to the first nozzle line and the second nozzle line in the predetermined direction by predetermined transportation amount by means of the transportation mechanism; and a group of nozzles that are not the first nozzles nor the second nozzles, wherein the image formation operation includes a certain image formation operation and another image formation operation, the controlling section performs control for forming a first image by using the first fluid in the certain image formation operation, the controlling section performs control for forming a second image on the first image by using the first fluid and the second fluid in the another image formation operation after lapse of time for drying the first image, the first nozzles that are used for forming the first image are located upstream of the first nozzles and the second nozzles that are used for forming the second image in the predetermined direction, the group of nozzles that are not the first nozzles nor the second nozzles are located downstream of the first nozzles that are used for forming the first image in the predetermined direction, the group of nozzles that are not the first nozzles nor the second nozzles are located upstream of the first nozzles and the second nozzles that are used for forming the second image in the predetermined direction, length of an area where the group of nozzles that are not the first nozzles nor the second nozzles are located in the predetermined direction is an integral multiple of the predetermined transportation amount, and the group of nozzles that are not the first nozzles nor the second nozzles do not eject any fluid.

6. A fluid ejecting method used by a fluid ejecting apparatus, the fluid ejecting apparatus having a first nozzle line and a second nozzle line, the first nozzle line including a plurality of first nozzles that are aligned in a predetermined direction for ejecting first fluid therefrom, the second nozzle line including a plurality of second nozzles that are aligned in the predetermined direction for ejecting second fluid therefrom, the fluid ejecting method comprising:

image formation operation for ejecting the first fluid from the first nozzles and ejecting the second fluid from the second nozzles while moving the first nozzle line and the second nozzle line in a movement direction that is orthogonal to the predetermined direction, the image formation operation including a certain image formation operation, and another image formation operation; and transportation operation for transporting a target medium relative to the first nozzle line and the second nozzle line in the predetermined direction by predetermined transportation amount, wherein the image formation operation and the transportation operation are performed repeatedly, in order to form a first image by using the first fluid and the second fluid in the certain image formation operation and form a second image on the first image by using the second fluid in the another image formation operation after lapse of time for drying the first image, the first fluid and the second fluid are respectively ejected from the first nozzles and the second nozzles that are used for forming the first image, and in addition, the second fluid is ejected from the second nozzles that are used for forming the second image and are located downstream of the first nozzles and the second nozzles that are used for forming the first image in the predetermined direction, a group of nozzles that are not the first nozzles nor the second nozzles are located downstream of the first nozzles and the second nozzles that are used for forming the first image in the predetermined direction, the group of nozzles that are not the first nozzles nor the second nozzles are located upstream of the second nozzles that are used for forming the second image in the predetermined direction, length of an area where the group of nozzles that are not the first nozzles nor the second nozzles are located in the predetermined direction is an integral multiple of the predetermined transportation amount, and the group of nozzles that are not the first nozzles nor the second nozzles do not eject any fluid.

* * * * *